US008989622B2

(12) United States Patent
Sato et al.

(10) Patent No.: US 8,989,622 B2
(45) Date of Patent: Mar. 24, 2015

(54) DEVELOPER-ACCOMMODATING VESSEL AND DEVELOPING DEVICE

(75) Inventors: Shougo Sato, Seto (JP); Susumu Sakuma, Kasugai (JP); Ryuya Yamazaki, Nagoya (JP); Shunsuke Ishii, Toki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1312 days.

(21) Appl. No.: 12/702,624

(22) Filed: Feb. 9, 2010

(65) Prior Publication Data

US 2010/0202803 A1 Aug. 12, 2010

(30) Foreign Application Priority Data

Feb. 9, 2009 (JP) ..... 2009-027008
Feb. 9, 2009 (JP) ..... 2009-027009
Apr. 28, 2009 (JP) ..... 2009-109614

(51) Int. Cl.
*G03G 15/00* (2006.01)
*G03G 15/04* (2006.01)
*G03G 15/08* (2006.01)
*G03G 21/18* (2006.01)

(52) U.S. Cl.
CPC ..... *G03G 15/0837* (2013.01); *G03G 15/0896* (2013.01); *G03G 21/1821* (2013.01); *G03G 2215/067* (2013.01)
USPC ..... 399/110; 399/119

(58) Field of Classification Search
USPC ..... 399/110, 111, 262, 263, 113
See application file for complete search history.

(56) References Cited

U.S. PATENT DOCUMENTS 5,419,468 A 5/1995 Taki
6,131,008 A 10/2000 Kanamori et al.
6,185,401 B1 2/2001 Kanamori et al.
6,337,956 B1 1/2002 Sato et al.
6,347,204 B1 2/2002 Kurosawa (Continued)

FOREIGN PATENT DOCUMENTS

EP 0 661 609 A2 7/1995
EP 0 727 719 8/1996

(Continued)

OTHER PUBLICATIONS

Extended European Search Report for application No. 11172811.9 mailed Aug. 29, 2011.

(Continued)

*Primary Examiner* — Erika J Villaluna
(74) *Attorney, Agent, or Firm* — Banner & Witcoff, Ltd.

(57) ABSTRACT

A toner cartridge is mountable on a process cartridge. The process cartridge includes a supply roller. The toner cartridge includes a first accommodating unit and an agitating member. The first toner accommodating unit has a peripheral surface in which an inner hollow space for accommodating a toner is formed. The agitating member is disposed in the first toner accommodating unit and rotates in a rotating direction to agitate the toner. The peripheral surface has a wall portion formed with a first supply-hole at an upstream side in the rotating direction. The wall portion is curved about a reference line as a center of curvature and depressed inward the first toner accommodating unit. The reference line is outside of the first toner accommodating unit in a radial direction of the agitating member and extending in a prescribed direction.

37 Claims, 19 Drawing Sheets

(56) References Cited

U.S. PATENT DOCUMENTS

| | | | | |
|---|---|---|---|---|
| 7,447,467 | B2 | 11/2008 | Kamimura et al. | |
| 2002/0150405 | A1 | 10/2002 | Tanisawa et al. | |
| 2003/0053819 | A1 | 3/2003 | Nomura et al. | |
| 2003/0161658 | A1 | 8/2003 | Park | |
| 2004/0184835 | A1 | 9/2004 | Park | |
| 2006/0140673 | A1 | 6/2006 | Kamimura et al. | |
| 2007/0065184 | A1 | 3/2007 | Sato | |
| 2007/0189811 | A1 | 8/2007 | Sato | |
| 2007/0223963 | A1 | 9/2007 | Suzuki et al. | |
| 2008/0226331 | A1* | 9/2008 | Allen et al. | 399/90 |
| 2009/0028602 | A1 | 1/2009 | Kamimura et al. | |
| 2009/0087227 | A1 | 4/2009 | Takagi et al. | |
| 2010/0209140 | A1 | 8/2010 | Kamimura et al. | |

FOREIGN PATENT DOCUMENTS

| | | | |
|---|---|---|---|
| JP | 6-035322 | A | 2/1994 |
| JP | 06-148968 | | 5/1994 |
| JP | 06-194886 | | 7/1994 |
| JP | 10-239969 | | 9/1998 |
| JP | 2001-005276 | A | 1/2001 |
| JP | 2002-311709 | A | 10/2002 |
| JP | 2003-015378 | | 1/2003 |
| JP | 2003-107892 | A | 4/2003 |
| JP | 2006-184552 | | 7/2006 |
| JP | 2006-267896 | | 10/2006 |
| JP | 2007-086324 | | 4/2007 |
| JP | 2007-212966 | A | 8/2007 |
| JP | 2008-176215 | | 7/2008 |
| JP | 2009-086505 | A | 4/2009 |

OTHER PUBLICATIONS

Japanese Office Action dated Dec. 7, 2010 in Japanese Patent Application No. 2009-027009 and English translation thereof.

Japanese Office Action dated Dec. 7, 2010 in Japanese Patent Application No. 2009-027008 and English translation thereof.

Japanese Office Action mailed Jan. 25, 2011 in Japanese Patent Application No. 2009-109614 and English translation thereof.

Office Action for Japanese patent application No. 2011-019491 mailed Mar. 29, 2011.

Partial European Search Report for corresponding European Patent Application 10153064.0 issued Sep. 14, 2010.

Chinese Office Action received in corresponding Patent Application No. 201010130096.5 mailed on Nov. 12, 2012.

* cited by examiner

REAR
RIGHT
UP
DOWN
LEFT
FRONT
100
101
102
103
104
105
106
107
108
112
113
114
115
116
117
118
119
120
121
122
123
124
24

UP
LEFT
REAR
FRONT
RIGHT
DOWN

DEVELOPER-ACCOMMODATING VESSEL AND DEVELOPING DEVICE

CROSS REFERENCE TO RELATED APPLICATIONS

This application claims priority from Japanese Patent Applications No. 2009-027008 filed Feb. 9, 2009, 2009-027009 filed Feb. 9, 2009, and 2009-109614 filed Apr. 28, 2009. The entire contents of these priority applications are incorporated herein by references.

TECHNICAL FIELD

The present invention relates to a developer-accommodating vessel and a developing device provided in a laser printer or other image-forming device.

BACKGROUND

A toner box is a conventional example of a developer-accommodating vessel provided in an image-forming device for accommodating developer used in image formation. The toner boxes disclosed in above-mentioned patent applications are detachably mounted in a process unit functioning as the developing device of a laser printer.

The developer-accommodating vessel includes an exterior casing having a first toner outlet formed therein, and an interior casing having a second toner outlet formed therein. The interior casing accommodates toner. An agitator is also provided in the interior casing for agitating the toner. The agitator rotates about a rotational shaft passing through the center of the circular interior casing. When the agitator is driven to rotate as the first toner outlet formed in the exterior casing is aligned with the second toner outlet formed in the interior casing, the toner agitated by the agitator in the interior casing is discharged sequentially through the second toner outlet and first toner outlet and is supplied to the process unit side.

A tandem type color printer is a type of image-forming device well known in the art having a plurality of photosensitive drums arranged in parallel and juxtaposed horizontally. This color printer includes a photosensitive drum unit comprising the plurality of photosensitive drums in one cohesive unit, a developing unit disposed below the photosensitive drum unit and functioning to form toner images on the photosensitive drums, and an intermediate transfer belt unit disposed above the photosensitive drum unit for receiving toner images transferred from the photosensitive drums.

The developing unit is provided with a number of developing devices equivalent to the number of photosensitive drums, which developing devices are arranged parallel to each other and juxtaposed horizontally. Each developing device includes a developer case for accommodating toner, and a developing roller disposed at the top of the developer case.

In order to perform maintenance on the photosensitive drum unit and developing unit with the printer, these units can be pulled out from the body of the printer in a horizontal direction following the juxtaposed direction of the photosensitive drums. Once the developing unit has been pulled out of the printer, the individual developing devices can be upwardly extracted from the developing unit.

SUMMARY

In the toner boxes, toner that is supplied from the interior casing of the toner box to the process unit side initially passes through the second toner outlet. However, the second toner outlet is formed in a circumferential surface of the interior casing and does not lie in the rotating path of the agitator. The rotating agitator conveys toner in the interior casing primarily in a direction along the path of the agitator, i.e., the rotating direction of the agitator.

In other words, since the second toner outlet is not provided in the rotating path of the agitator, the agitator cannot efficiently supply toner from the interior casing to the process unit through the second toner outlet.

Further, replacing the developer case is a maintenance activity that is frequently performed in the printer. However, since the developer case, which must be accessed most frequently, is disposed in the bottom of each developing device, it is necessary to remove the developing roller and the like disposed in the top of the developing unit before refilling the developer case with toner or replacing the developer case. Thus, maintenance of the developer case is troublesome.

Further, when the photosensitive drum unit and developer unit are pulled out of the printer together, the photosensitive drum unit disposed on top of the developing unit must be removed in order to remove the developing roller and the like, as described above, making maintenance of the developer case even more troublesome.

Therefore, it is an object of the present invention to provide a developer-accommodating vessel capable of efficiently supplying developer externally, and an image-forming device having a structure in which a plurality of developing units are disposed below a plurality of photosensitive drums juxtaposed in parallel and that is capable of facilitating maintenance of the developer-accommodating vessels disposed in the developing unit for accommodating developer.

In order to attain above and other object, the present invention provides a toner cartridge. The toner cartridge includes a first toner accommodating unit and an agitating member. The first toner accommodating unit has a peripheral surface in which an inner hollow space for accommodating a toner is formed. The agitating member is disposed in the first toner accommodating unit and rotates in a rotating direction to agitate the toner. The peripheral surface has a wall portion formed with a first supply-hole at an upstream side in the rotating direction. The wall portion is curved about a reference line as a center of curvature and depressed inward the first toner accommodating unit. The reference line is outside of the first toner accommodating unit in a radial direction of the agitating member and extending in a prescribed direction.

According to another aspect, the present invention provides a developing device. The developing device includes a casing, a supply roller, and a toner cartridge. The supply roller is mounted on the casing. The toner cartridge is mountable on the casing. The toner cartridge includes a first toner accommodating unit and an agitating member. The first toner accommodating unit has a peripheral surface in which an inner hollow space for accommodating a toner is formed. The agitating member is disposed in the first toner accommodating unit and rotates in a rotating direction to agitate the toner. The peripheral surface has a wall portion formed with a first supply-hole at an upstream side in the rotating direction. The wall portion is curved about a reference line as a center of curvature and depressed inward the first toner accommodating unit. The reference line is outside of the first toner accommodating unit in a radial direction of the agitating member and extending in a prescribed direction.

According to still another aspect, the present invention provides an image forming device. The image forming device includes a casing, a photosensitive drum, a developing device, a toner cartridge, and a support frame. The photosensitive drum rotates about a rotational axis. The developing device is disposed beneath the photosensitive drum. The toner cartridge accommodates the toner and is detachably mounted on the developing device to supply the toner. The support frame is drawable from the casing while integrally supporting the developing device and the toner cartridge. The support frame has an allowing unit that allows the toner cartridge to be detached from the developing device while maintaining the developing device to be supported, when the support frame is drawn from the casing.

BRIEF DESCRIPTION OF THE DRAWINGS

The particular features and advantages of the invention as well as other objects will become apparent from the following description taken in connection with the accompanying drawings, in which.

DETAILED DESCRIPTION

1. General Structure of a Color Printer

Figure 1:
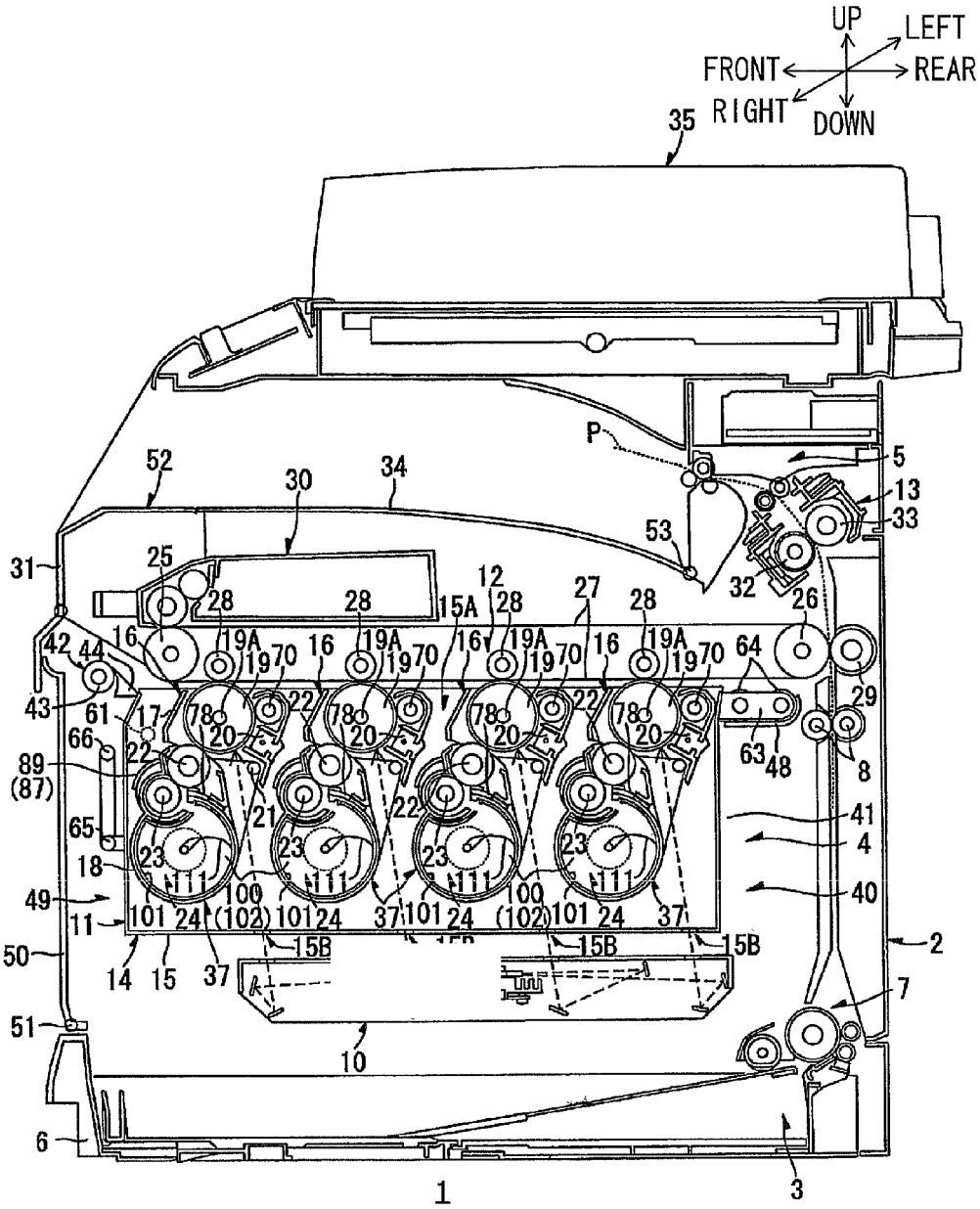
FIG. 1 is a right side cross-sectional view of a color printer 1 according to a first embodiment of the present invention.
Figure 2:
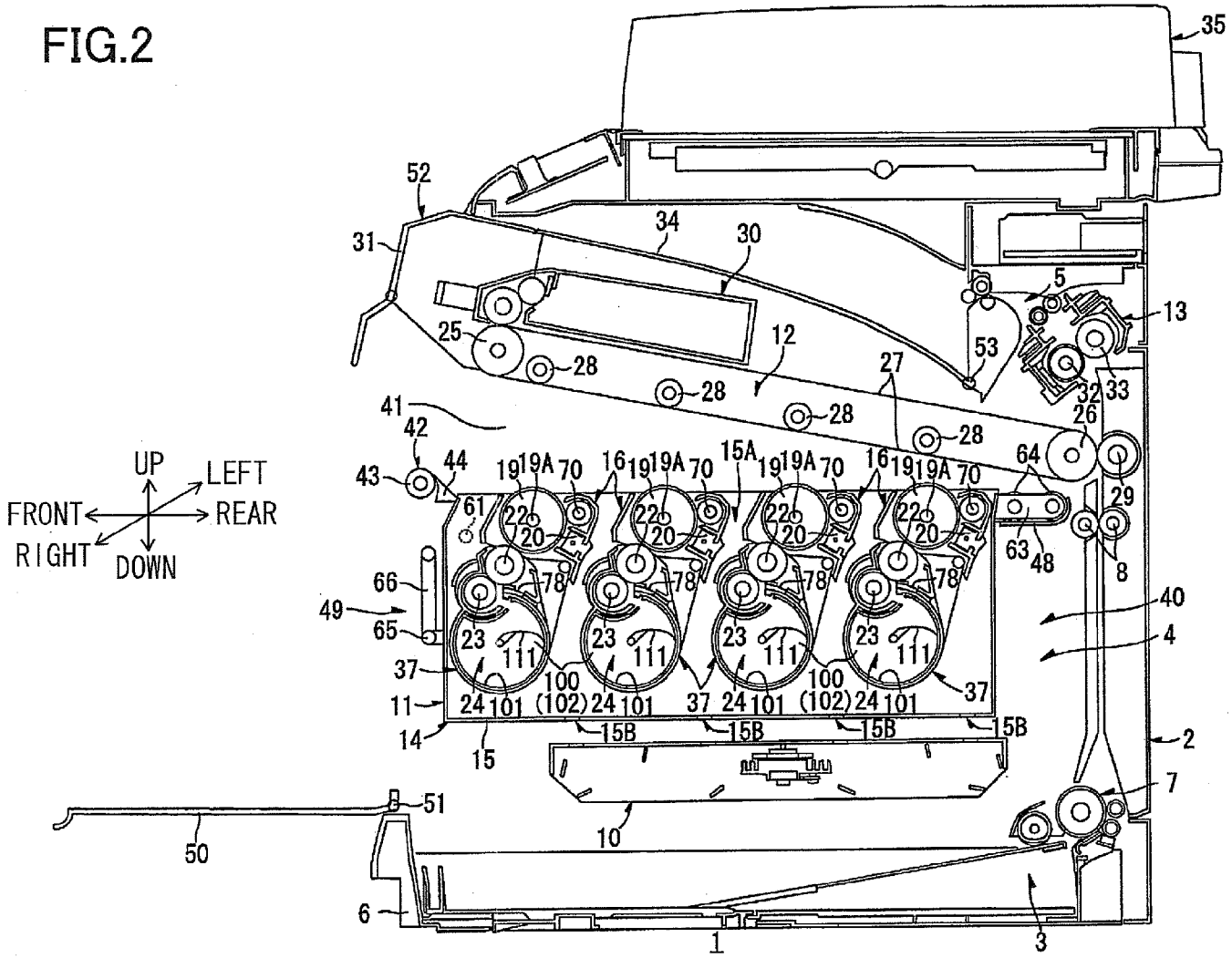
FIG. 2 is a schematic cross-sectional view of the color printer when a first front cover moves upward and a second front cover is open.
Figure 3:
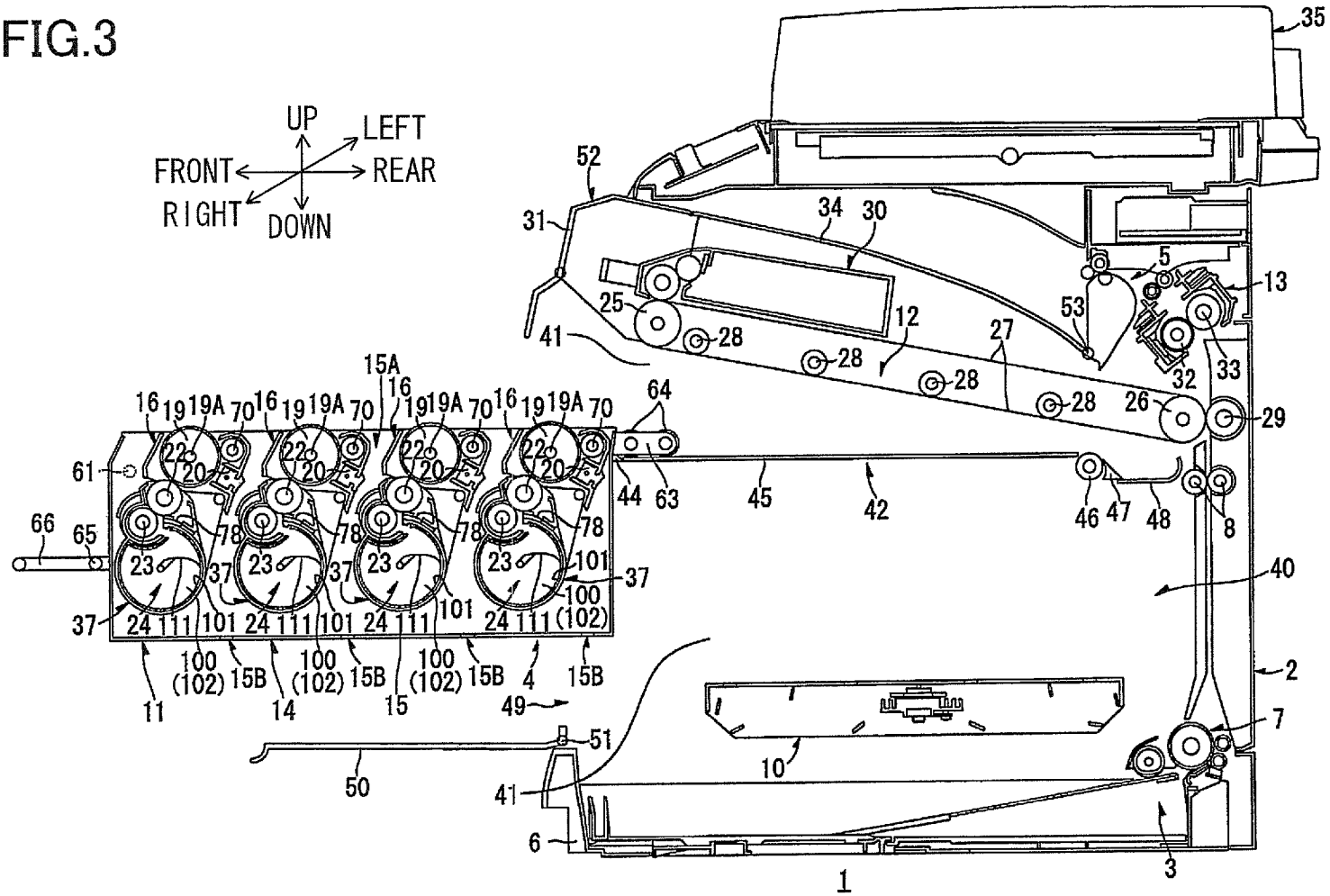
FIG. 3 is a right side cross-sectional view of the color printer in a state that a drawer unit is extracted.
Figure 4:
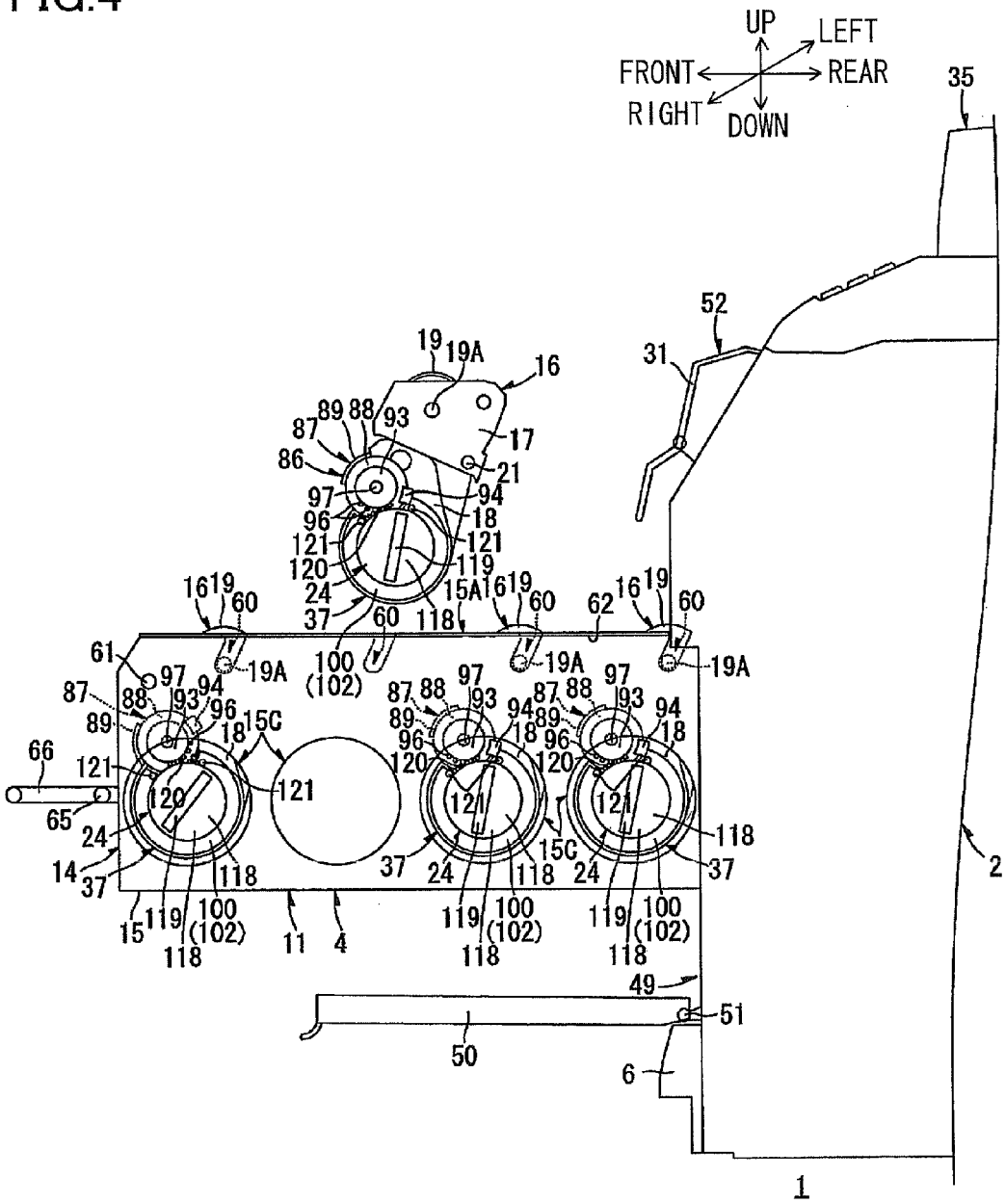
FIG. 4 is an enlarged right side cross-sectional view of the color printer.

FIG. 1 is a right side cross-sectional view of a color printer 1 serving as the image-forming device according to a first embodiment of the present invention. FIG. 2 shows the same view of the color printer 1 in FIG. 1 when a unit-mounting opening 49 is open. FIG. 3 shows the color printer 1 in FIG. 1 when a drawer unit 14 has been pulled out from a main casing 2. FIG. 4 is a right side view of the color printer 1 in the state shown in FIG. 3. For the sake of description, one process cartridge 16 is shown in FIG. 4 after being extracted upward from the drawer unit 14.

As shown in FIG. 1, the color printer 1 includes a main casing 2 forming the body of the color printer 1. The main casing 2 is box-shaped and slightly elongated vertically.

Within the main casing 2, the color printer 1 also includes a feeding unit 3 for supplying sheets of a paper P to be printed, an image-forming unit 4 for forming images on the paper P supplied from the feeding unit 3, and a discharge unit 5 for discharging the paper P from the main casing 2 after an image has been formed thereon. The main casing 2 is provided with a first front cover 31 and a second front cover 50 on a front wall thereof.

Unless otherwise specified, the orientation of the color printer 1 and the orientation of the individual components in the color printer 1 will be described in accordance with the directional arrows shown in the drawing. This holds true for FIG. 1 as well as subsequent drawings. The directions specified herein are defined based on the perspective of a user standing in front of the color printer 1 while facing the color printer 1. Thus, the left side of the color printer 1 is the far side of the drawing in FIG. 1, while the right side is the near side. The left-to-right direction will also be referred to as the width direction, and both the left-to-right (width) direction and the front-to-rear direction are considered horizontal directions.

(1) Feeding Unit

The feeding unit 3 includes a paper tray 6, a feeding mechanism 7, and a pair of registration rollers 8.

The paper tray 6 is disposed in the bottom section of the main casing 2 and extends in a horizontal direction. The paper tray 6 may be removed from the main casing 2 on the front side thereof. The paper tray 6 holds sheets of paper P in a stacked state. The feeding mechanism 7 is disposed at the rear end of the paper tray 6 and functions to feed sheets of paper P from the paper tray 6 toward the image-forming unit 4. The feeding mechanism 7 includes components well known in the art for which reference numerals have not been assigned in FIG. 1, including a feeding roller, a separating roller, a separating pad, a paper dust roller, and a paper-conveying path. With this configuration, the feeding mechanism 7 functions to separate and feed sheets of paper P accommodated in the paper tray 6 upward to the registration rollers 8 one sheet at a time.

When the leading edge of the sheet of paper P reaches the registration rollers 8, the registration rollers 8 adjust the registration of the sheet and subsequently convey the sheet of paper P to the image-forming unit 4 at a prescribed timing.

(2) Image-forming Unit

The image-forming unit 4 includes a scanning unit 10, a process unit 11, a transfer unit 12, and a fixing unit 13.

(2-1) Scanning Unit

The scanning unit 10 is disposed in the bottom section of the main casing 2 above the paper tray 6. The scanning unit 10 includes various components well known in the art for which reference numerals have not been assigned in FIG. 1, including a laser light-emitting unit, a polygon mirror, and a plurality of lenses and reflecting mirrors. The laser light-emitting unit of the scanning unit 10 emits laser beams based on image data inputted from a device external to the color printer 1 or from an image-reading unit 35 described later. The laser beams are guided along paths indicated by dotted lines in FIG. 1 and are ultimately irradiated onto photosensitive drums 19 described later that are provided in the process unit 11.

(2-2) Process Unit

The process unit 11 is disposed above the scanning unit 10 and includes a drawer unit 14.

The drawer unit 14 is detachably mounted in the main casing 2. As will be described later, the drawer unit 14 is mounted in and removed from the main casing 2 along the front-to-rear direction. The drawer unit 14 includes a hollow, box-shaped drawer frame 15, and four process cartridges 16 disposed inside the drawer frame 15.

An opening 15A is formed in nearly the entire top surface of the drawer frame 15. The opening 15A provides communication between the interior of the drawer frame 15 and the region above the drawer frame 15. A plurality of through-holes 15B is formed in the bottom wall of the drawer frame 15. The laser beams irradiated by the laser light-emitting units in the scanning unit 10 pass through corresponding through-holes 15B before being irradiated on the photosensitive drums 19. Four circular exposure holes 15C (see FIG. 4) are formed in the right wall of the drawer frame 15 at positions aligned in the front-to-rear direction. The circular exposure holes 15C penetrate the right wall of the drawer frame 15 in the width direction so as to provide communication with the interior of the drawer frame 15.

The process cartridges 16 are detachably mounted in the drawer frame 15 via the opening 15A. When viewed along the width direction, the four process cartridges 16 mounted in the drawer frame 15 are arranged parallel to each other and juxtaposed at substantially equal intervals in the front-to-rear direction (almost horizontally). Each of the process cartridges 16 is disposed at a slight incline to the vertical, with the top positioned farther rearward than the bottom.

The following description of the process cartridges 16 will be based on the state of the process cartridges 16 when they are mounted in the drawer frame 15 and oriented at a slight incline to the vertical, with the top farther rearward from the bottom. Since the structure of the four process cartridges 16 is identical, the following description will focus on the forward-most process cartridge 16 in FIG. 1.

Each process cartridge 16 is provided with an upper case 17 on the top side, and a lower case 18 on the bottom. Together, the upper case 17 and lower case 18 form a hollow box shape elongated in the width direction. The upper case 17 primarily accommodates a photosensitive drum 19 and a charger 20.

The photosensitive drum 19 has a central shaft 19A extending in the width direction. Hence, the axial direction of the photosensitive drum 19 corresponds to this width direction, and the photosensitive drum 19 is elongated in the width direction. The widthwise ends of the photosensitive drum 19 are rotatably supported in corresponding side walls constituting the widthwise side walls of the upper case 17. The top of the upper case 17 is open so that the upper peripheral surface of the photosensitive drum 19 is exposed in the top surface of the upper case 17 from a perspective above the upper case 17 (process cartridge 16). The upper peripheral surface of the photosensitive drum 19 is also exposed through the opening 15A of the drawer frame 15 from a perspective above the drawer frame 15 (drawer unit 14). When viewed from the top, the four photosensitive drums 19 are arranged parallel to each other and juxtaposed at substantially equivalent intervals in the front-to-rear direction (nearly horizontal).

The charger 20 is held between both widthwise side walls of the upper case 17 and is positioned to oppose the lower rear surface of the corresponding photosensitive drum 19 from a distance. The lower case 18 is coupled to the upper case 17 by means of a coupling shaft 21 inserted through the upper rear corners of the lower case 18 in the width direction as shown in FIG. 4. With the coupling shaft 21, the lower case 18 can move relative to the upper case 17, and more specifically, can pivot relative to the upper case 17 about the coupling shaft 21.

The lower case 18 primarily accommodates a developing roller 22, a supply roller 23, and a toner box 24. Central shafts for each of the developing roller 22 and supply roller 23 extend in the width direction. The lower case 18 has widthwise side walls in which both widthwise ends of the developing roller 22 and supply roller 23 are rotatably supported.

The developing roller 22 is disposed in the upper end of the lower case 18. The top of the lower case 18 is open so that the upper peripheral surface of the developing roller 22 is exposed in the top surface of the lower case 18 from a perspective above the lower case 18.

The upper case 17 is also open on the bottom so that the upper peripheral surface of the developing roller 22 exposed in the top opening of the lower case 18 opposes and contacts the lower front peripheral surface of the photosensitive drum 19 through the bottom opening in the upper case 17. More specifically, urging members (not shown) are provided for urging the entire lower case 18 supporting the developing roller 22 upward toward the upper case 17 supporting the photosensitive drum 19 so that the developing roller 22 contacts the photosensitive drum 19.

The supply roller 23 is disposed in contact with the developing roller 22 on the lower front side thereof. The toner box 24 is disposed in an area of the lower case 18 below the supply roller 23 (a box-accommodating chamber 73 described later; see FIG. 5C). As will be described later, the toner box 24 is detachably mounted in the lower case 18. The toner box 24 is formed with an inner hollow space and has a substantially cylindrical shape that is elongated in the width direction. The toner box 24 accommodates toner in the inner hollow space in one of the corresponding colors cyan, magenta, yellow, or black.

The lower case 18 and the group of members accommodated in the lower case 18 (the developing roller 22, supply roller 23, toner box 24, and the like) are referred to as a developing unit 37. The number of developing units 37 is equivalent to the number of process cartridges 16 (four in the preferred embodiment), and each developing unit 37 is disposed below a corresponding upper case 17 (i.e., below the photosensitive drum 19 provided in the upper case 17). The drawer unit 14 including the process cartridges 16 and toner boxes 24 is described below in greater detail.

When forming images with this process unit 11, the charger 20 in each process cartridge 16 applies a uniform electrical charge to the peripheral surface of the corresponding photosensitive drum 19. Subsequently, the scanning unit 10 irradiates a laser beam (indicated by a dotted line in FIG. 1) onto the peripheral surface of the charged photosensitive drum 19 via the corresponding through-hole 15B formed in the bottom surface of the drawer frame 15, forming an electrostatic latent image on the peripheral surface of the photosensitive drum 19 that corresponds to an image to be formed on paper P.

In the meantime, components in the developing unit 37 of each process cartridge 16 supply toner from the toner box 24 downward to the supply roller 23 (this will be described later in greater detail). The supply roller 23 supplies the toner received from the toner box 24 to the developing roller 22. The developing roller 22 carries on its peripheral surface a thin layer of toner that has been regulated to a prescribed thickness.

As the photosensitive drum 19 rotates, the electrostatic latent image formed on the peripheral surface of the photosensitive drum 19 rotates into a position opposite the developing roller 22, at which time the toner carried on the surface of the developing roller 22 is supplied to the electrostatic latent image, developing the latent image into a visible toner image of the prescribed color.

Thus, each developing unit 37 functions to develop an electrostatic latent image found on the corresponding photosensitive drum 19. Further, the toner box 24 in each developing unit 37 accommodates toner used to develop the latent image on the corresponding photosensitive drum 19.

(2-3) Transfer Unit

The transfer unit 12 includes a follow roller 25, a drive roller 26, an intermediate transfer belt 27, primary transfer rollers 28, a secondary transfer roller 29, and a cleaning unit 30.

The follow roller 25 and drive roller 26 are disposed parallel to each other and separated in the front-to-rear direction. The endless intermediate transfer belt 27 is looped over and pulled taut between the follow roller 25 and drive roller 26. In this state, the intermediate transfer belt 27 is adjacent to the top side of the drawer unit 14. When the drive roller 26 is driven to rotate, the intermediate transfer belt 27 moves circularly about the follow roller 25 and drive roller 26, while the follow roller 25 follows the rotation of the drive roller 26.

Four primary transfer rollers 28 are arranged inside the intermediate transfer belt 27 at intervals in the front-to-rear direction. Each primary transfer rollers 28 is positioned opposite a corresponding photosensitive drum 19 so as to pinch the lower portion of the intermediate transfer belt 27 against the photosensitive drum 19. The position at which the photosensitive drum 19 contacts the intermediate transfer belt 27 is referred to as a primary transfer position. A high voltage circuit board (not shown) applies a first transfer bias to the primary transfer rollers 28, causing the toner image on each photosensitive drum 19 to be transferred onto the intermediate transfer belt 27 at the corresponding primary transfer position. Toner images in four colors transferred from the four photosensitive drums 19 become superimposed on the intermediate transfer belt 27 to form a color toner image.

The secondary transfer roller 29 is disposed on the rear side of the drive roller 26 and applies pressure to the drive roller 26 via the intermediate transfer belt 27. The position at which the secondary transfer roller 29 contacts the drive roller 26 (intermediate transfer belt 27) is referred to as a secondary transfer position. A high voltage circuit board (not shown) applies a second transfer bias to the secondary transfer roller 29, causing the color toner image formed on the intermediate transfer belt 27 to be transferred onto a sheet of paper P at the secondary transfer position as the registration rollers 8 convey the sheet upward.

The cleaning unit 30 is disposed above the intermediate transfer belt 27. The cleaning unit 30 functions to recover toner remaining on the intermediate transfer belt 27 after the toner image has been transferred to the paper P and to retain the toner within. The cleaning unit 30 may be replaced by opening the first front cover 31 rotatably attached to the front wall of the main casing 2.

(2-4) Fixing Unit

The fixing unit 13 is disposed on the downstream side of the transfer unit 12 with respect to the conveying direction of the paper P, and more specifically above the contact position between the drive roller 26 and secondary transfer roller 29 (second transfer position). The fixing unit 13 includes a heating roller 32 and a pressure roller 33 well known in the art. The pressure roller 33 contacts and applies pressure to the heating roller 32. As a sheet of paper P passes between the heating roller 32 and pressure roller 33, the toner image transferred onto the sheet is fixed to the sheet by heat and pressure.

(3) Discharge Unit

The discharge unit 5 has a plurality of conveying rollers (not indicated with reference numerals in FIG. 1) for conveying a sheet of paper P discharged from the fixing unit 13 onto a discharge tray 34 formed on top of the main casing 2.

(4) Other Components

An image-reading unit 35 is provided in the main casing 2 at a position covering the top of the discharge tray 34. The image-reading unit 35 takes in an original document and scans image data from the document. The color printer 1 can form images based on the image data scanned by the image-reading unit 35.

Thus, the color printer 1 can both read and form images and is therefore referred to as a multifunction peripheral. The color printer 1 is also referred to as an in-body paper discharge type device, since the sheets of paper P are discharged onto the discharge tray 34, which is located vertically midway in the main casing 2 (below the image-reading unit 35).

Next, the components of the color printer 1 will be described in greater detail.

2. Main Casing

A unit-accommodating chamber 40 is formed in the main casing 2 for accommodating the drawer unit 14. The unit-accommodating chamber 40 is a space defined vertically by the intermediate transfer belt 27 and the scanning unit 10. As shown in FIG. 3, a pair of partitioning walls 41 is provided in the main casing 2 for defining the left and right boundaries of the unit-accommodating chamber 40. Only the left partitioning wall 41 is shown in FIG. 3.

A guide part 42 is provided inner surfaces of the partitioning walls 41 (the right surface in the case of the left partitioning wall 41 shown in FIG. 3). As shown in FIGS. 2 and 3, the guide part 42 includes in order beginning from the front side, a first guiding roller 43, a first sloped wall 44, a first guiding rail 45, a second guiding roller 46, a second sloped wall 47, and a second guiding rail 48.

The first guiding roller 43 is rotatably disposed on the front end of the corresponding partitioning wall 41 (see FIG. 2). The first guiding rail 45 is formed in a plate shape that extends evenly in the front-to-rear direction (see FIG. 3). The front end of the first guiding rail 45 is in proximity with the rear side of the first guiding roller 43 (not illustrated in the drawings). The first guiding rail 45 is disposed at a vertical position that is substantially equivalent to the lower portion of the first guiding roller 43 (see FIGS. 2 and 3).

When viewed along the width direction, the first sloped wall 44 is substantially triangular in shape, narrowing toward the rear side (see FIG. 2). The top surface of the first sloped wall 44 slopes downward from the top part of the first guiding roller 43 to the top surface of the first guiding rail 45 (see FIGS. 2 and 3).

As shown in FIG. 3, the second guiding roller 46 is rotatably disposed on the rear end of the corresponding partitioning wall 41 adjacent to the rear end of the first guiding rail 45. The second guiding roller 46 is positioned so that its upper part is substantially equivalent in position to the first guiding rail 45 relative to the vertical.

The second guiding rail 48 is formed in a plate shape that extends evenly in the front-to-rear direction, and then curves upward on the rear end. The second guiding rail 48 is disposed at substantially the same position as the lower portion of the second guiding roller 46 with respect to the vertical. When viewed along the width direction, the second sloped wall 47 has a substantially triangular shape, tapering toward the rear. The top surface of the second sloped wall 47 slopes downward from the top portion of the second guiding roller 46 to the top surface of the second guiding rail 48.

As shown in FIG. 1, a unit-mounting opening 49 is formed in the front wall of the main casing 2. The unit-mounting opening 49 allows communication between the area on the front side of the color printer 1 and the unit-accommodating chamber 40 (see FIGS. 2 and 3). The second front cover 50 is provided on the front wall of the main casing 2 and is capable of opening and closing thereon. In the closed state shown in FIG. 1 the second front cover 50 is in an erect orientation and blocks the unit-mounting opening 49 on the front side thereof. In this state of the second front cover 50, a rotational shaft 51 extending in the width direction penetrates the bottom edge of the second front cover 50. The second front cover 50 is coupled to the front wall of the main casing 2 via the rotational shaft 51 and is capable of pivotally rotating about the rotational shaft 51. When an operator pulls the second front cover 50 forward from the closed position shown in FIG. 1, the second front cover 50 rotates forward and downward about the rotational shaft 51 (see FIGS. 2 through 4). At this time, the second front cover 50 is in the open state and the unit-mounting opening 49 is exposed on the front side of the color printer 1 (see FIGS. 2 and 3).

A pivoting unit 52 is provided in the main casing 2 above the second front cover 50 when the second front cover 50 is in the closed state. The pivoting unit 52 is an integrated unit that includes the discharge tray 34 and various parts positioned beneath the discharge tray 34 (specifically the intermediate transfer belt 27, follow roller 25, drive roller 26, primary transfer rollers 28, and cleaning unit 30), as well as the first front cover 31 described earlier. The pivoting unit 52 is capable of pivoting about the drive roller 26 of the transfer unit 12 and a pivoting shaft 53 disposed on the rear side of the discharge tray 34 so that the front of the pivoting unit 52 moves vertically.

When the second front cover 50 is in the closed state shown in FIG. 1, the lower front end of the pivoting unit 52 is engaged with the top end of the second front cover 50, restricting forward rotation of the second front cover 50. Therefore, the second front cover 50 can be maintained in the closed state.

When the pivoting unit 52 is pivoted upward from the state shown in FIG. 1 to the state shown in FIG. 2, the lower front end of the pivoting unit 52 disengages from the top end of the second front cover 50, allowing the second front cover 50 to be rotated forward and downward. By rotating the second front cover 50 downward on the front side, the operator can expose the unit-mounting opening 49 described above.

3. Drawer Unit (1) Drawer frame

As shown in FIG. 4, the drawer frame 15 has a hollow box shape with the opening 15A formed in the top surface.

Four guiding grooves 60 are formed in the inner widthwise surface on each widthwise side walls of the drawer frame 15 (i.e., the widthwise surfaces of the drawer frame 15 facing inwardly). The guiding grooves 60 are formed in the upper end of the side walls at substantially equal intervals in the front-to-rear direction and extend downward along a forward slope from the top edge of the inner surface. The innermost part (bottom end) of each guiding groove 60 is rounded so that each guiding groove 60 has a substantial U-shape when viewed in the width direction.

A positioning shaft 61 is integrally provided on the upper front corner of each widthwise wall of the drawer frame 15, protruding outward in the width direction therefrom. The top edge of each widthwise wall of the drawer frame 15 is bent outward in the width direction to form a flange 62.

As shown in FIG. 3, a protruding piece 63 is integrally provided on the upper rear end of each widthwise wall in the drawer frame 15, protruding rearward. Two wheels 64 juxtaposed in the front-to-rear direction are provided on each protruding piece 63. Rotational shafts of the wheels 64 extend in the width direction and are supported in the protruding pieces 63. Thus, the wheels 64 are rotatably supported by the protruding pieces 63.

A rotational shaft 65 and a handle 66 are provided on the front wall of the drawer frame 15. The rotational shaft 65 extends in the width direction and is supported in the front wall of the drawer frame 15. The rotational shaft 65 is inserted through one end (the rear end in FIG. 3) of the handle 66, by which the handle 66 is capable of rotating about the rotational shaft 65 (see FIGS. 1 through 4). The operator grips the handle 66 when mounting the drawer unit 14 in or removing the drawer unit 14 from the main casing 2.

(2) Process Cartridges

FIG. 5 shows one of the process cartridges 16 when a process shutter 83 and a toner shutter 112 described later are both in an open position. FIG. 5A is a right side cross-sectional view of the process cartridge 16; FIG. 5B is a right side view of the process, cartridge 16; and FIG. 5C illustrates the process cartridge 16 when the toner box 24 is separated from all other parts of the process cartridge 16.

FIG. 6 shows the process cartridge 16 when the process shutter 83 and the toner shutter 112 are both in a closed position. FIG. 6A is a right side cross-sectional view of the process cartridge 16; FIG. 6B is a right side view of the process cartridge 16; and FIG. 6C shows the process cartridge 16 when the toner box 24 is separated from all other parts of the process cartridge 16.

(2-1) Upper Case and Lower Case

Figure 5A:
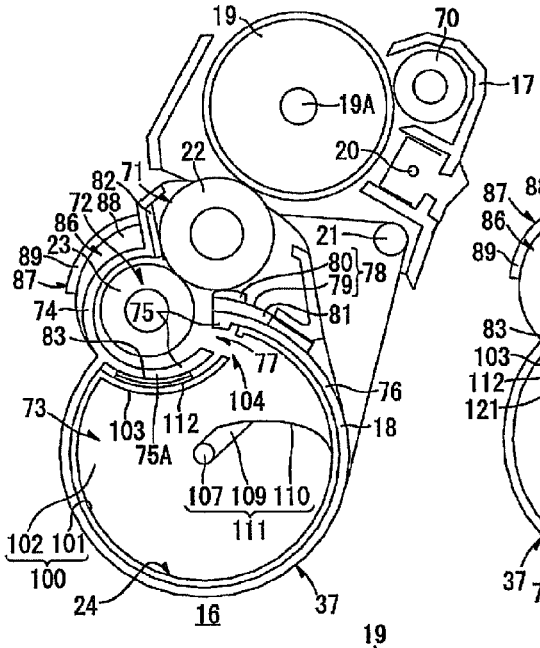
FIG. 5A is a right-side cross-sectional view of a process cartridge with a toner shutter and a process shutter open.

As shown in FIG. 5A, the upper case 17 of each process cartridge 16 has a hollow box shape elongated in the width direction and open on the top and bottom surfaces. The upper case 17 supports the photosensitive drum 19 and charger 20. Both widthwise ends of the central shaft 19A of the photosensitive drum 19 penetrate the corresponding side walls of the upper case 17 in the width direction and protrude outward from the upper case 17 in the width direction (see FIG. 5B).

A cleaning roller 70 is rotatably supported in the upper case 17 above the charger 20. The outer peripheral surface of the cleaning roller 70 contacts the outer surface of the photosensitive drum 19 on the rear side thereof. The cleaning roller 70 functions to remove the toner and other foreign matter from the peripheral surface of the photosensitive drum 19 after a toner image has been transferred from the photosensitive drum 19 to the intermediate transfer belt 27 (see FIG. 1).

As described above, the lower case 18 has a hollow box shape elongated in the width direction and is open on the top. While the lower case 18 can move relative to the upper case 17, which is coupled to the lower case 18 via the coupling shaft 21, as described above, the lower case 18 in FIG. 5A is fixed in position so that the developing roller 22 contacts the lower front side of the photosensitive drum 19.

When viewed along the width direction, the lower case 18 resembles a teardrop that is wider toward the bottom. Accordingly, the interior of the lower case 18 also grows wider in the front-to-rear direction toward the bottom side. The interior of the lower case 18 is partitioned into a developing chamber 71, a supply chamber 72, and a box-accommodating chamber 73 in order from top to bottom.

When viewed along the width direction, the developing chamber 71 appears to be shaped substantially like a parallelogram tilted downward to the rear. The developing chamber 71 is exposed from above (outside of the lower case 18) through the open top surface of the lower case 18.

Viewed in the width direction, the supply chamber 72 is substantially circular in shape and in communication with the lower front side of the developing chamber 71.

An arced wall 74 forming part of the front wall of the lower case 18 corresponding to the supply chamber 72 bulges forward in an arc shape. A first protruding wall 75 integrally provided on the front wall of the lower case 18 protrudes continuously from the lower edge of the arced wall 74 in a rearward direction into the lower case 18 and at the same curvature as the arced wall 74. Viewed along the width direction, the first protruding wall 75 is substantially shaped like a letter U that has been flattened vertically so as to curve in an arc that is convex on the bottom side. Viewed from the right side, the arced wall 74 and first protruding wall 75 together are shaped like the letter C with an opening in the rear side. The region within the C-shaped portion formed by the arced wall 74 and first protruding wall 75 is the supply chamber 72.

When viewed in the width direction, the box-accommodating chamber 73 is substantially circular in shape and more than twice the size of the supply chamber 72. More specifically, a portion of the circumference of the circularly shaped box-accommodating chamber 73 in a side view is depressed inwardly to form an arc shape that is concave on the top. The bottom wall of the lower case 18 (including the lower ends of the front wall and rear wall) is formed in an arc shape conforming to the shape of the box-accommodating chamber 73 that is convex on the bottom. A second protruding wall 76 integrally provided on the rear wall of the lower case 18 is formed continuously with the rear end on the bottom wall of the lower case 18 and protrudes upward and forward into the lower case 18 at the same curvature as the bottom wall. The second protruding wall 76 is arc-shaped when viewed in the width direction and extends upward and forward while bulging upward and rearward. The rear end of the first protruding wall 75 described above is connected to the front (top) end of the second protruding wall 76. The second protruding wall 76 defines the lower rear side of the developing chamber 71.

In a right side view, the bottom wall of the lower case 18 and the second protruding wall 76 are taken together form an approximate C-shape having a cutout part in the top. The first protruding wall 75 is provided in the cutout region of this C-shape and protrudes thereto. The box-accommodating chamber 73 is the region defined by the bottom wall of the lower case 18, the second protruding wall 76, and the first protruding wall 75. The toner box 24 (and the toner shutter 112 and an agitator 111 described later provided in the toner box 24) is accommodated in the box-accommodating chamber 73, as shown in FIG. 5A.

A box-mounting opening 84 that is substantially circular and is approximately the same shape as the box-accommodating chamber 73 when viewed along the width direction is formed in a portion of the right wall in the lower case 18 corresponding to the box-accommodating chamber 73 in the width direction. The box-accommodating chamber 73 is exposed on the right side of the lower case 18 through the box-mounting opening 84 (see FIG. 5C). The portion of the left wall of the lower case 18 aligned with the box-accommodating chamber 73 in the width direction is substantially circular in shape and approximately the same shape and size as the box-accommodating chamber 73 in the width direction. A coupling gear 85 is rotatably disposed in the center of this circular region (see FIG. 5C).

A single through-hole 77 is formed in the upper rear portion of the first protruding wall 75, which appears to be shaped substantially like the letter U (or a tray) that has been flattened vertically when viewed along the width direction. The through-hole 77 is a slit extending in the width direction that penetrates the first protruding wall 75 in the front-to-rear direction to provide communication between the supply chamber 72 and box-accommodating chamber 73. Specifically, the box-accommodating chamber 73 communicates with the lower rear portion of the supply chamber 72 via the through-hole 77. Since the through-hole 77 is formed in the upper rear side of the first protruding wall 75, part of the first protruding wall 75 is positioned lower than the lower edge defining the through-hole 77. This part is an accumulating part 75A.

With this configuration of the lower case 18, the developing roller 22 described earlier is disposed in the developing chamber 71, and the supply roller 23 is disposed in the supply chamber 72. The lower peripheral surface of the supply roller 23 opposes the first protruding wall 75 from above and follows the upper curved surface of the first protruding wall 75. The through-hole 77 formed in the first protruding wall 75 confronts the lower rear portion of the supply roller 23.

A thickness-regulating blade 78 is also disposed in the developing chamber 71. The thickness-regulating blade 78 is integrally provided with a leaf spring 79 formed in a thin plate shape elongated in the width direction, and a rubber pressing part 80 disposed on the front end of the leaf spring 79. The leaf spring 79 extends from the rear wall of the lower case 18 in a direction upward and forward along the second protruding wall 76 toward the bottom peripheral surface of the developing roller 22. The elastic force of the leaf spring 79 presses the pressing part 80 against the bottom peripheral surface of the developing roller 22. The gap between the leaf spring 79 and the second protruding wall 76 is filled by a seal 81. The gap between the front peripheral surface of the developing roller 22 and the front wall of the lower case 18 is filled by a seal 82.

The process shutter 83 is provided in the lower case 18 for opening and closing the through-hole 77. The process shutter 83 has a thin plate shape elongated in the width direction. In the width direction, the process shutter 83 is shaped substantially like a letter U that has been flattened vertically, similar to the first protruding wall 75 and is positioned along the bottom of the first protruding wall 75. The process shutter 83 can slide in a direction along the curved surface of the first protruding wall 75. The toner shutter 112 mentioned earlier is positioned immediately below the process shutter 83 in FIG. 5A.

In FIG. 5A, the entire process shutter 83 is positioned below the first protruding wall 75. This position is the open position in which the process shutter 83 is shifted downward and forward from the through-hole 77. When the process shutter 83 is in the open position, the through-hole 77 is open.

Figure 6A:
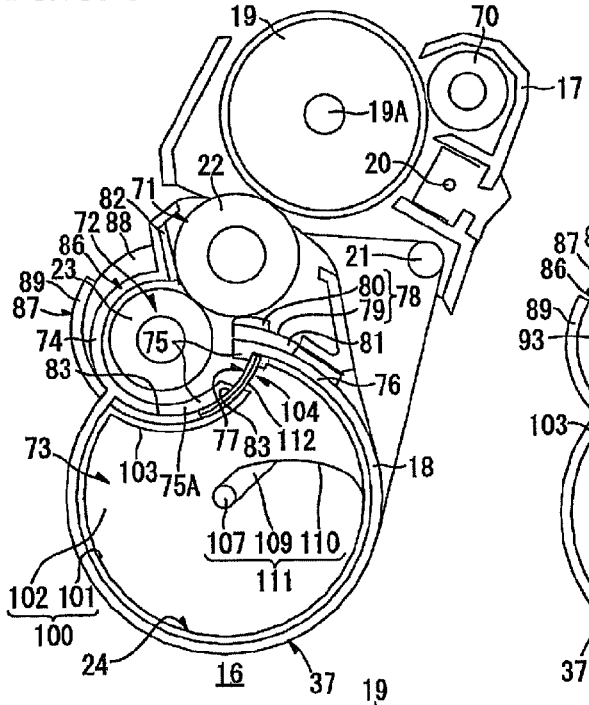
FIG. 6A is a right side cross-sectional view of a process cartridge with the toner shutter and the process shutter close.

When the process shutter 83 is slid a prescribed amount from the open position upward and rearward along the lower surface of the first protruding wall 75, the process shutter 83 arrives in the closed position shown in FIG. 6A. In the closed position, the process shutter 83 blocks the entire through-hole 77 from the bottom rear side.

The process shutter 83 is returned to the open position shown in FIG. 5A when slid a prescribed distance from the closed position along a downward and forward arc following the lower surface of the first protruding wall 75.

A support member 86 is disposed in the lower case 18 for supporting the process shutter 83. The support member 86 is formed integrally with the process shutter 83. Taken together, the process shutter 83 and support member 86 constitute a shutter unit 87.

Figure 7:
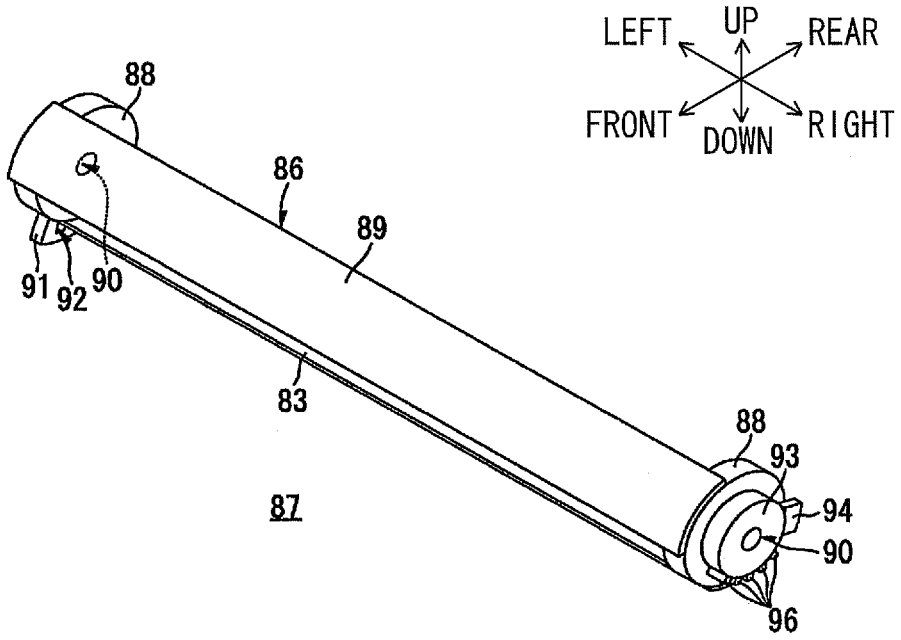
FIG. 7 is a perspective view of a shutter unit as viewed from a right-front side.

FIG. 7 is a perspective view of the shutter unit 87 from a front right viewpoint. Next, the components of the shutter unit 87 will be described with reference to FIG. 7. The following description will be based on the orientation of the shutter unit 87 in FIG. 7. The support member 86 is integrally provided with a pair of left and right rotating plates 88 connected to corresponding widthwise ends of the process shutter 83, and a beam member 89 spanning between the top portions of the left and right rotating plates 88.

The rotating plates 88 are formed in thin plate shapes with the thin dimension corresponding to the width direction and appear substantially circular in shape when viewed along the width direction. A through-hole 90 is formed in the circular center position of each rotating plate 88.

A left protruding part 91 is integrally formed on the peripheral surface of the left rotating plate 88 at one location in the circumferential direction (the bottom of the rotating plate 88 in FIG. 7) and protrudes radially outward from the left rotating plate 88 (downward in FIG. 7). As with the rotating plates 88, the protruding part 91 is also formed thin in the width direction and is substantially shaped like the letter U following the lower peripheral edge of the left rotating plate 88 when viewed along the width direction (see FIG. 5C). Two left recess parts 92 are formed in the right surface of the protruding part 91 at positions along the circumferential direction of the left rotating plate 88 (see FIG. 5C).

A right protruding part 93 is integrally provided on the right side surface of the right rotating plate 88. The right protruding part 93 has a thin plate shape with the thin dimension corresponding to the width direction and has a circular shape when viewed in the width direction with a diameter smaller than that of the right rotating plate 88. The right protruding part 93 is concentric with the right rotating plate 88. The circular center of the right protruding part 93 is aligned with the circular center of the right rotating plate 88 in the width direction. Further, the through-hole 90 described above that is formed in the right rotating plate 88 penetrates both the right rotating plate 88 and the right protruding part 93 at the center thereof.

Figure 5B:
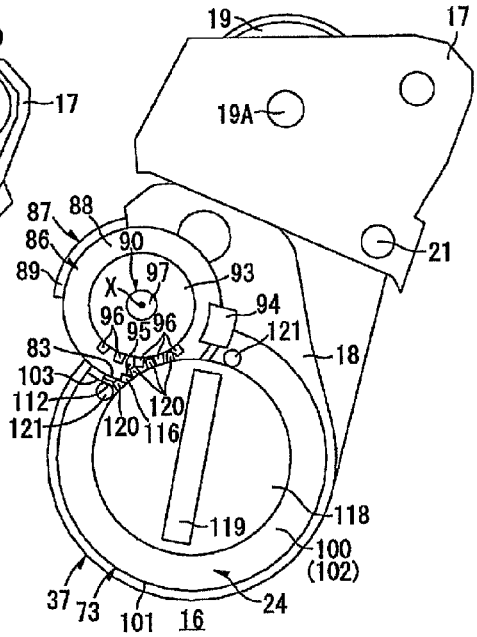
FIG. 5B is a right-side view of the process cartridge with the toner shutter and the process shutter open.
Figure 5C:
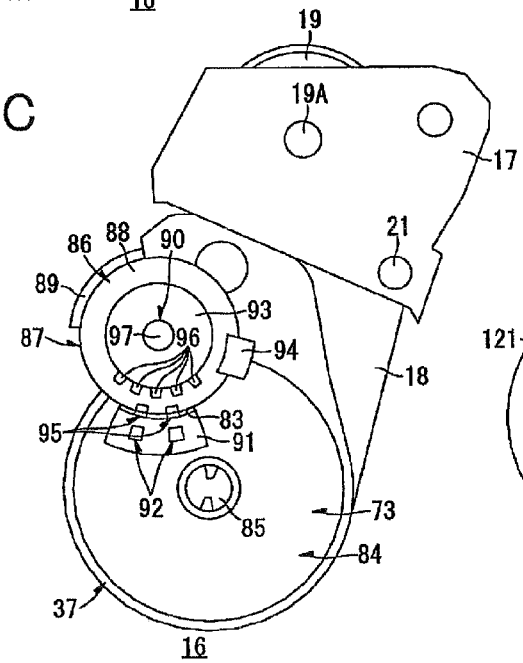
FIG. 5C is a right-side view of the process cartridge in which a toner box is dismounted therefrom with the toner shutter and the process shutter open.
Figure 5C:
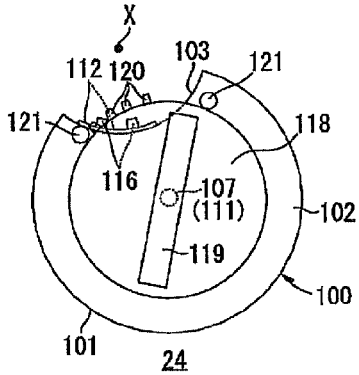
Figure 5C:
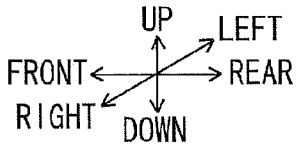

As shown in FIG. 5C, a protruding part 94 is integrally provided on the right side surface of the right rotating plate 88 at one location along the outer circumference thereof (the part on the rear side of the right protruding part 93 in FIG. 7). The protruding part 94 protrudes radially outward from the right rotating plate 88 (rearward in FIG. 7). The protruding part 94 protrudes farther outward than the peripheral surface of the right rotating plate 88 on the right side thereof (see FIG. 5C).

Two right recessed parts 95 are formed in the right surface of the right rotating plate 88 along the peripheral edge thereof and at positions different from the protruding part 94 with respect to the circumferential direction of the right rotating plate 88 (positions lower than the right protruding part 93 in FIG. 7). The right recessed parts 95 are arranged along the circumferential direction of the rotating plate 88 (see FIG. 5C).

A rack gear 96 is formed on the outer peripheral surface of the right protruding part 93 in a position corresponding to the right recessed parts 95 with respect to the circumferential direction of the right protruding part 93 (the rotating plate 88; near the bottom end of the right protruding part 93 in FIG. 7; see also FIG. 5C). The rack gear 96 has a plurality of gear teeth that are arranged along the circumference of the right protruding part 93.

The left end of the process shutter 83 is connected to a part of the left rotating plate 88 (the lower end of the left rotating plate 88 in FIG. 7) on which the protruding part 91 (and specifically the left recess parts 92) is provided, while the right end is connected to a part of the right rotating plate 88 (the lower end of the right rotating plate 88 in FIG. 7) in which the right recessed parts 95 are formed. In FIG. 7, the process shutter 83 spans between the lower ends of the left and right rotating plates 88. The two right recessed parts 95 are continuously formed in the process shutter 83 from the right rotating plate 85 (see FIG. 5C). In other words, it may be said that the right recessed parts 95 are provided in the process shutter 83.

If the protruding part 91 is treated as part of the process shutter 83, then it may be considered that the left recess parts 92 formed in the protruding part 91 are provided in the process shutter 83.

The beam member 89 has a plate shape extending in the width direction and spans between outer peripheral surfaces of the left and right rotating plates 88 at a different position along the circumference of the rotating plates 88 than the process shutter 83. When viewed along the width direction, the beam member 89 is curved in an arc that follows the outer peripheral surfaces of the left and right rotating plates 88.

The shutter unit 87 having a construction described-above is rotatably supported by the lower case 18, as shown in FIG. 5C. More specifically, in the shutter unit 87 having this construction, the left rotating plate 88 is positioned farther leftward than the left side surface of the lower case 18 (not shown), while the right rotating plate 88 is positioned farther rightward than the right side surface of the lower case 18. In this state, the left and right rotating plates 88 are aligned in the width direction with the entire supply chamber 72 and the lower left portion of the developing chamber 71 formed in the lower case 18 (see FIG. 5A).

Further, the process shutter 83 of the shutter unit 87 is accommodated in the box-accommodating chamber 73 of the lower case 18, while the beam member 89 is positioned farther forward from the front side surface of the lower case 18

(the front wall portion of the lower case 18 in the vicinity of the arced wall 74; see FIG. 5A).

Hence, only the process shutter 83 of the shutter unit 87 is positioned within the lower case 18, while all other parts of the shutter unit 87 are disposed outside of the lower case 18 (or outside of the process cartridge 16).

A support shaft 97 is integrally provided on the outer surface of each widthwise side wall of the lower case 18 at a position aligned with the center of curvature of the first protruding wall 75 (see FIG. 5A). The support shafts 97 protrude outward in the width direction from their corresponding outer surfaces. Each support shaft 97 is inserted into the through-hole 90 formed in the rotating plate 88 on the same widthwise side of the shutter unit 87. The support shaft 97 is inserted from the inside of the through-hole 90 in the width direction.

With this construction, the entire shutter unit 87 can freely rotate about the support shafts 97 provided on widthwise side walls of the lower case 18 in either a clockwise or counterclockwise direction when viewing the shutter unit 87 on the right side. Thus, the support shafts 97 on the lower case 18 serve as the rotational center of the shutter unit 87. The shutter unit 87 can rotate freely within a range in which the process shutter 83 slides between the open position and closed position described above.

When the process shutter 83 is in the open position shown in FIG. 5A, the beam member 89 contacts a portion of the front wall of the lower case 18 near the upper end of the arced wall 74 from the front side thereof. This contact restricts the shutter unit 87 from rotating clockwise in a right side view.

When the process shutter 83 is in this open position, the shutter unit 87 is rotated counterclockwise in a right side view until the beam member 89 contacts the front wall of the lower case 18 near the lower end of the arced wall 74 from the upper front side, as shown in FIG. 6A. This contact restricts the shutter unit 87 from rotating farther in the counterclockwise direction in a right side view. At this point, the process shutter 83 is in the closed position.

(2-2) Toner Box

Figures 8A, 8B, 8C, 8D, 8E:
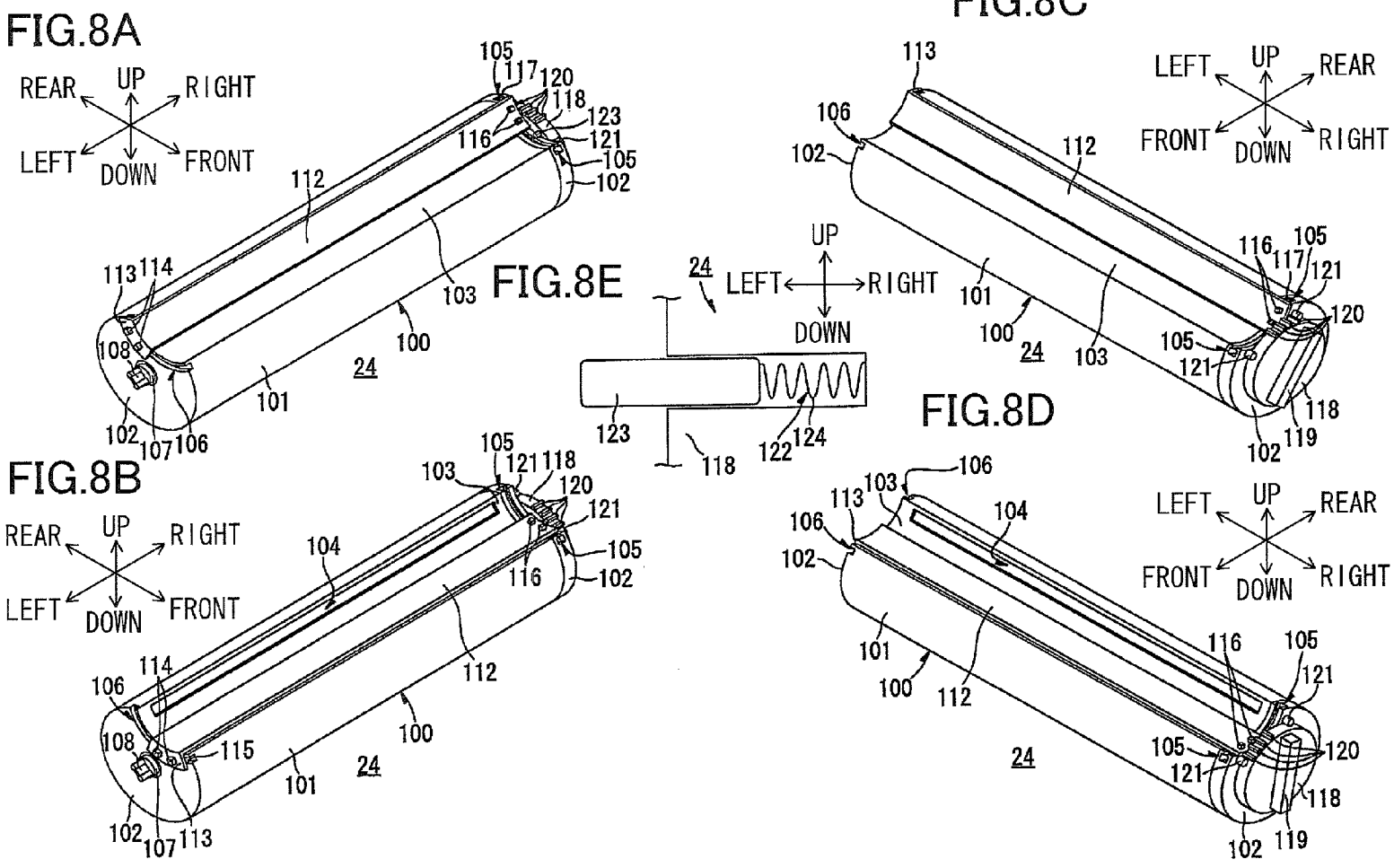
FIG. 8A is a perspective view of the toner box with the toner shutter close as viewed from the left-front side.
FIG. 8B is a perspective view of the toner box with the toner shutter open as viewed from the left-front side.
FIG. 8C is a perspective view of the toner box with the toner shutter close as viewed from the right-front side.
FIG. 8D is a perspective view of the toner box with the toner shutter open as viewed from the right-front side.
FIG. 8E is a partial cross-sectional view around a pawl of the toner box.

FIG. 8A is a perspective view from the left front side of the toner box 24 when the toner shutter 112 is in the closed position. FIG. 8B is a perspective view from the left front side of the toner box 24 when the toner shutter 112 is in the open position. FIG. 8C is a perspective view from the right front side of the toner box 24 when the toner shutter 112 is in the closed position. FIG. 8D is a perspective view from the right front side of the toner box 24 when the toner shutter 112 is in the open position. FIG. 8E is a front cross-sectional view showing relevant parts of the toner box 24.

The toner box 24 is hollow with a substantially cylindrical shape elongated in the width direction, as described above. As shown in FIG. 8, a box casing 100 forms the outer shell of the toner box 24 and has a hollow, substantially cylindrical shape elongated in the width direction. Hence, a cross section of the box casing 100 viewed along the width direction is substantially circular in shape (see FIG. 5A). The box casing 100 is closed on both widthwise ends and accommodates toner therein. The box casing 100 is integrally provided with a circumferential wall 101 forming the outer circumferential (peripheral) surface thereof, and a pair of side walls 102 covering both widthwise ends of the circumferential wall 101.

A curved wall 103 is formed along one peripheral portion (upper portion) of the circumferential wall 101, extending across the entire width of the circumferential wall 101 (box casing 100). The curved wall 103 is depressed inward toward the circular center of the circumferential wall 101 (toward the interior of the box casing 100) to form an arc-shaped curve. When viewed along the width direction, the curved wall 103 is substantially U-shaped. In other words, as shown in FIG. 5C, the curved wall 103 is curved in an arc shape whose center of curvature is a reference line X extending in the width direction. The reference line X positions outside (above) the box casing 100 in a radial direction of the circular center of the circumferential wall 101 as viewed along width direction (a radial to an agitator shaft 107 described later). The curvature of the curved wall 103 is substantially identical to that of the first protruding wall 75 in the lower case 18 of the process cartridge 16 (see FIG. 5A). The curved wall 103 functions to guide the toner after passing through a supply hole 104 described later.

As shown in FIG. 8B, the side walls 102 have the same shape as the circumferential wall 101 when viewed along the width direction. That is, each side wall 102 is substantially circular in shape, with one portion of the outer peripheral edge cut out in an arc. Thus, the box casing 100 comprising the circumferential wall 101 and side walls 102 is hollow and substantially cylindrical in shape, with one region on the outer peripheral surface depressed inwardly in an arc that extends across the entire width direction. Consequently, the interior space of the box casing 100 is also substantially circular in shape, but has one portion in the outer peripheral edge cut out in an arc shape when viewed along the width direction.

A supply hole 104 elongated in the width direction is formed in and penetrates the outer surface of the curved wall 103 (the surface exposed on the outside) near the rear edge of the curved wall 103. The width dimension of the supply hole 104 is slightly smaller than that of the curved wall 103. The supply hole 104 provides communication between the interior and exterior of the box casing 100.

A right guide groove 105 is formed in the outer surface of the curved wall 103 at a position farther rightward than the supply hole 104 and is recessed toward the circular center of the circumferential wall 101 (toward the interior of the box casing 100). When viewed along the width direction, the right guide groove 105 forms an arc shape that follows the outer curved surface of the curved wall 103. A cross section of the right guide groove 105 forms a convex shape that grows narrower toward the outer surface of the curved wall 103. In other words, the width of the right guide groove 105 is wider at its deepest point than at the surface of the curved wall 103.

A left guide groove 106 is formed in the left side surface of the left side wall 102 in an area following the curved wall 103 and is recessed rightward. The left guide groove 106 has an arc shape that follows the curved wall 103 and is substantially U-shaped when viewed along the width direction. The agitator shaft 107 extending along the width direction spans between the center parts of the circular left and right side walls 102 and is rotatably supported in these side walls 102. The left end of the agitator shaft 107 protrudes farther leftward than the left side surface of the left side wall 102. An input gear 108 is integrally provided on the left end of the agitator shaft 107 and protrudes leftward from this left end.

As shown in FIG. 5A, a support part 109 is integrally provided on the outer peripheral surface of the agitator shaft 107 within the box casing 100 and protrudes radially outward from the agitator shaft 107. The support part 109 is formed of a hard material (hard resin or the like). When viewed in the width direction, the support part 109 grows narrower away from the agitator shaft 107 in the radial direction.

An agitating blade 110 is attached to the support part 109. The agitating blade 110 is formed of a flexible material, such as film. The agitating blade 110 is supported on the support part 109 and extends outward from the support part 109 along the radial direction of the agitator shaft 107 to the inner surface of the circumferential wall 101 forming the box casing 100. The natural length of the agitating blade 110 with respect to the radial direction of the agitator shaft 107 is greater than the distance between the support part 109 and the inner surface of the circumferential wall 101. Accordingly, the agitating blade 110 contacts the inner surface of the circumferential wall 101 and is slightly bowed in the box casing 100. When viewed from the right side, as in FIG. 5A, the side of the agitating blade 110 toward the inner surface side of the circumferential wall 101 is bowed in a clockwise direction with respect to the support part 109.

The agitator shaft 107, support part 109, and agitating blade 110 together configure the agitator 111. Excluding the left end part of the agitator shaft 107, the agitator 111 is disposed entirely in the toner box 24 (and specifically the box casing 100). In a right side view, the agitator 111 can rotate in the counterclockwise direction about the agitator shaft 107.

In one rotation of the agitator 111, the agitating blade 110 passes over and contacts the entire inner surface of the circumferential wall 101 (including the curved wall 103). Since the agitator 111 rotates (and the agitating blade 110 passes over the circumferential wall 101) in the counterclockwise direction when viewed from the right side, the supply hole 104 formed at the rear end of the curved wall 103 is on the upstream side of the curved wall 103 with respect to the rotating direction of the agitator 111.

As shown in FIG. 8B, the toner shutter 112 is provided in the toner box 24. The toner shutter 112 is plate-shaped and elongated in the width direction. When viewed along the width direction, the toner shutter 112 is arc-shaped with approximately the same curvature as the curved wall 103 of the box casing 100 (see FIG. 5A). The widthwise dimension of the toner shutter 112 is approximately the same as that of the curved wall 103, while the dimension of the toner shutter 112 in the circumferential direction (the direction of the curved surface) is about half that of the curved wall 103.

A folded part 113 is integrally provided on the left end of the toner shutter 112. The folded part 113 is bent in a direction orthogonal to the width direction and away from the center of curvature of the toner shutter 112 (downward in FIG. 8B). The folded part 113 has a plate shape that is thin in the width direction and is connected to the left end of the toner shutter 112 along the entire periphery thereof.

Two left protrusions 114 are integrally provided on the left side surface of the folded part 113. The left protrusions 114 are spaced from each other in the circumferential direction of the toner shutter 112 and protrude leftward. A left guide rib 115 is integrally provided on the right side surface of the folded part 113. The left guide rib 115 protrudes rightward and extends along the circumferential direction of the toner shutter 112.

Two right protrusions 116 are integrally provided on the outer surface of the toner shutter 112 (the surface exposed externally from the toner box 24; the top surface in FIG. 8B) near the right end thereof. The right protrusions 116 are spaced an interval in the circumferential direction of the toner shutter 112 and protrude in a direction toward the center of curvature of the toner shutter 112 (upward in FIG. 8B).

A right guide rib 117 is integrally provided on the underside surface of the toner shutter 112 (although not shown in FIG. 8B, the bottom surface of the toner shutter 112 the same drawing) and extends along the circumferential direction of the toner shutter 112 (see FIGS. 8A and 8C). The right guide rib 117 protrudes in a direction orthogonal to the width direction and away from the center of curvature of the toner shutter 112 (downward in FIG. 8A).

The toner shutter 112 is supported in the curved wall 103 of the box casing 100. More specifically, the left guide rib 115 of the toner shutter 112 is fitted into the left guide groove 106 formed in the box casing 100 from the left side, while the right guide rib 117 is fitted into the right guide groove 105 of the box casing 100 from the top in FIG. 8B. With this construction, the toner shutter 112 is supported by the box casing 100 at multiple points along the width direction (i.e., at the left guide rib 115 and right guide rib 117).

In this state, the left guide rib 115 can freely slide within the left guide groove 106 along the circumferential direction of the curved wall 103, and the right guide rib 117 can freely slide within the right guide groove 105 along the circumferential direction of the curved wall 103.

Using the drawing of FIG. 8A as a reference, the bottom surface of the toner shutter 112 is disposed over the outer surface (top surface) of the curved wall 103 and opposes this outer surface along substantially the entire width direction. In this state, the toner shutter 112 can freely slide along the circumferential direction of the curved wall 103 between the open position shown in FIGS. 8B and 8D and the closed position shown in FIGS. 8A and 8C.

In the open position, the toner shutter 112 is shifted to the front side of the supply hole 104 so that the entire supply hole 104 is exposed (open) on the outside (the top; see FIGS. 8B and 8D). In the closed position, the toner shutter 112 is aligned with the supply hole 104, covering the entire supply hole 104 on the outside (see FIGS. 8A and 8C). Thus, the supply hole 104 is opened and closed by shifting the toner shutter 112 along the circumferential direction of the curved wall 103.

As shown in FIG. 8D, an operating part 118 is provided in the toner box 24 on the right side surface of the right side wall 102. The operating part 118 is plate-shaped with its thin dimension corresponding to the width direction. The operating part 118 is circular-shaped in a right side view, with a smaller diameter than the side wall 102. The center of the circular operating part 118 is aligned with the center of the circular right side wall 102 (the agitator shaft 107); in the width direction (see FIGS. 5A and 5C).

A grip part 119 is integrally provided on the right side surface of the operating part 118. The grip part 119 has a narrow square columnar shape that extends along a straight line passing through the center of the circular operating part 118 in a right side view. A rack gear 120 is formed on the outer peripheral surface of the operating part 118 at one location on the circumference thereof. With respect to FIG. 8D in which the grip part 119 extends vertically, the rack gear 120 is formed at a position shifted slightly counterclockwise from the top end of the grip part 119 in a right side view. The rack gear 120 has a plurality of gear teeth arranged along the circumferential direction of the operating part 118.

The operating part 118 is supported on the right side wall 102 and is capable of rotating freely about its own center. Bosses 121 are integrally provided on the right side surface of the right side wall 102 adjacent to the operating part 118 and at positions on either side of the curved wall 103 with respect to the circumferential direction of the substantially circular side wall 102 (see FIG. 5C). The bosses 121 are cylindrical in shape and protrude rightward.

With the operating part 118 rotatably supported by the right side wall 102, as described above, the rack gear 120 of the operating part 118 is disposed between the two bosses 121 with respect to the circumferential direction of the side wall 102 (or operating part 118). Accordingly, the operating part 118 may be rotated between a position in which the rack gear 120 contacts the forward boss 121, as shown in FIG. 8D (hereinafter referred to as the "forward position"), and a position in which the rack gear 120 contacts the rearward boss 121, as shown in FIG. 8C (hereinafter referred to as the "rearward position"). An operator rotates the operating part 118 by gripping and twisting the grip part 119.

When in the forward position, the operating part 118 can be moved to the rearward position by rotating the grip part 119 all the way clockwise in a right side view. From the rearward position, the operating part 118 can be returned to the forward position by rotating the operating part 118 all the counterclockwise in a right side view.

When looking at the toner box 24 by itself, the toner shutter 112 and operating part 118 are not mechanically coupled together, and the toner shutter 112 slides independent of the rotation of the operating part 118. Therefore, the toner shutter 112 does not slide when the operating part 118 is rotated in a standalone toner box 24. The toner shutter 112 is in the closed position in this state (see FIG. 8C).

As shown in FIG. 8E, a recessed part 122 is formed at one location in the left peripheral edge of the operating part 118. A cylindrical pawl 123 elongated in the width direction is fitted into the recessed part 122. A spring 124 has one end coupled to the right end of the pawl 123 and another end coupled to the portion of the operating part 118 defining the bottom of the recessed part 122. The spring 124 urges the pawl 123 leftward.

When the operating part 118 is in the rearward position shown in FIG. 8C, the left end of the pawl 123 protrudes leftward from the recessed part 122, as shown in FIGS. 8A and 8E. The left end of the pawl 123 contacts the right outer surface of the curved wall 103 near the rearward boss 121 from the upstream side with respect to the counterclockwise direction in a right side view. While the pawl 123 remains in contact with the curved wall 103 in this state, the operating part 118 cannot be rotated counterclockwise in a right side view.

On the other hand, when the operating part 118 is in the forward position shown in FIG. 8D, the pawl 123 does not catch on the curved wall 103, as described above, but is almost completely accommodated in the recessed part 122 (see FIG. 8E) while opposing the right side surface of the right side wall 102.

(2-3) Mounting and Removal of the Toner Box with Respect to the Process Cartridge Next, the procedure for mounting the toner box 24 in and removing the toner box 24 from the process cartridge 16 (and specifically the developing unit 37) will be described.

Figure 6B:
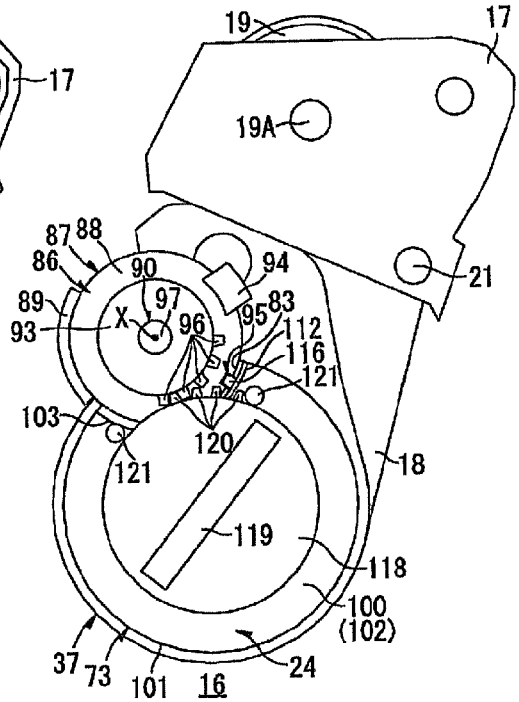
FIG. 6B is a right-side view of the process cartridge with the toner shutter and the process shutter close.
Figure 6C:
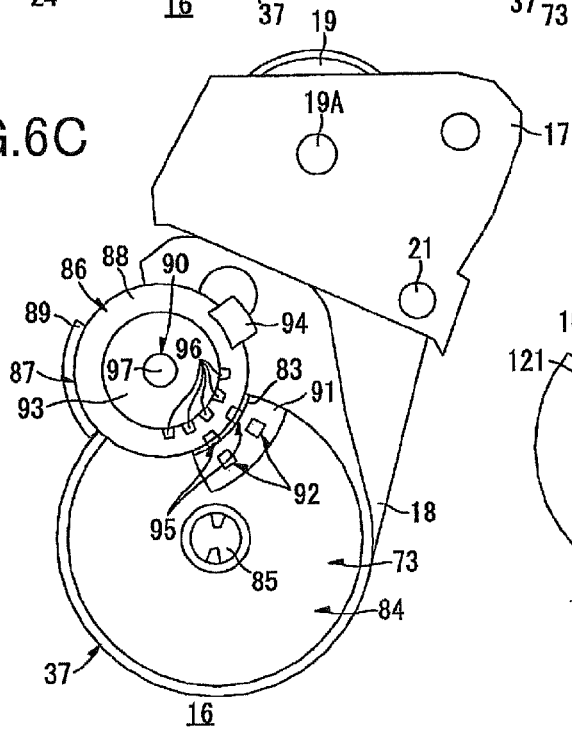
FIG. 6C is a right-side view of the process cartridge in which the toner box is dismounted therefrom with the toner shutter and the process shutter close.
Figure 6C:
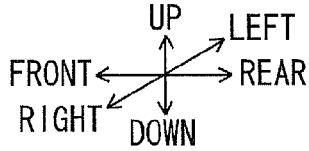
Figure 6C:
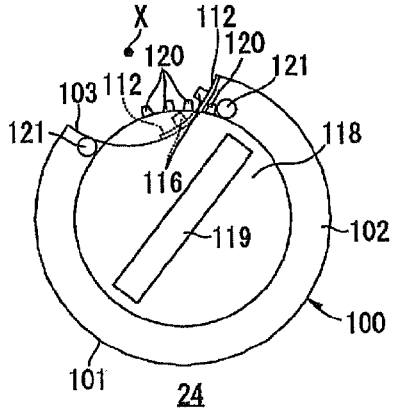

Before mounting the toner box 24 in the process cartridge 16, the process shutter 83 is in the closed position in the lower case 18 of the process cartridge 16, as shown in FIG. 6C (see also FIG. 6A). In the toner box 24, the toner shutter 112 is in the closed position and the operating part 118 is in the rearward position, as shown in FIGS. 8A and 8C.

In this state, the toner box 24 is oriented with the curved wall 103 on the top side and disposed on the right side of the box-mounting opening 84 formed in the right side wall of the lower case 18 (the near side in FIG. 6). From this position, the toner box 24 is pushed leftward so that the left end (the end with the input gear 108) of the toner box 24 enters the box-mounting opening 84 first. The toner box 24 is pushed through the box-mounting opening 84 until fully accommodated in the box-accommodating chamber 73, as shown in FIG. 6B.

When the toner box 24 is fully accommodated in the box-accommodating chamber 73, the operation for mounting the toner box 24 in the process cartridge 16 (in the lower case 18 of the developing unit 37) is complete.

As shown in FIG. 6A, the toner box 24 is almost a perfect fit in the box-accommodating chamber 73 at this time and is positioned lower than the supply roller 23 when viewed in the width direction. Further, the curved wall 103 of the toner box 24 opposes the bottom of the first protruding wall 75 provided in the lower case 18 and closely conforms to the shape of the first protruding wall 75. When both the process shutter 83 and the toner shutter 112 are in the closed position, the top surface (outer surface) of the toner shutter 112 closely contacts the bottom surface of the process shutter 83 in the closed position from the lower rear side. Further, the support shaft 97 of the lower case 18 (rotational center of the shutter unit 87) is aligned with the reference line X (a line extending in the width direction and passing through the center of curvature of the curved wall 103 provided in the toner box 24) in, the width direction (see FIG. 6B).

At the same time, the right side surface of the toner box 24 (and particularly the operating part 118) is exposed through the box-mounting opening 84 (see FIG. 6C) in the right side of the lower case 18 (see FIG. 6B). Since the toner box 24 is mounted leftward into the developing unit 37, the operating part 118 on the right side surface of the toner box 24 is disposed on the upstream side of the toner box 24 relative to the mounting direction. However, since the input gear 108 (see FIG. 8A) is provided on the left side surface of the toner box 24, the input gear 108 is on the downstream side of the toner box 24 relative to the mounting direction.

The supply hole 104 of the curved wall 103 confronts the through-hole 77 in the first protruding wall 75 from the lower rear side with the process shutter 83 and toner shutter 112 interposed therebetween, since both the process shutter 83 and the toner shutter 112 are in the closed position. In this state, the supply hole 104 and through-hole 77 are not in communication with each other.

The input gear 108 of the toner box 24 (see FIG. 8A) is coupled with the coupling gear 85 provided on the left side wall of the lower case 18 (see FIG. 6C). When the process cartridge 16 is mounted in the main casing 2, the coupling gear 85 is coupled with a drive source (not shown) provided in the main casing 2. By coupling the input gear 108 to the coupling gear 85 in this case, the input gear 108 can be coupled to the main casing 2 via the coupling gear 85. Consequently, the input gear 108 can receive a drive force from the drive source in the main casing 2 and transfer this drive force to the agitator shaft 107 (and thereby to the agitator 111).

The left protrusions 114 provided on the toner shutter 112 (see FIG. 8A) are fitted from the right into the corresponding left recess parts 92 (see FIG. 6C) formed in the protruding part 91, which is disposed on the left rotating plate 88 (see FIG. 7) of the process shutter 83 (and specifically the shutter unit 87). Further, the right protrusions 116 provided on the toner shutter 112 (see FIG. 8A) are fitted from the right into the right recessed parts 95 provided on the right side of the process shutter 83 (see FIG. 6C).

When the toner box 24 is mounted in the lower case 18, the left protrusions 114 are engaged in the left recess parts 92 and the right protrusions 116 are engaged in the right recessed parts 95 within the developing unit 37. Through these engagements, the toner shutter 112 is coupled with the process shutter 83.

Further, when the toner box 24 is mounted in the corresponding process cartridge 16 (developing unit 37), the rack gear 120 provided on the operating part 118 of the toner box 24 meshes with the rack gear 96 provided on the right protruding part 93 of the shutter unit 87 from the bottom side thereof, as shown in FIG. 6B. Hence, the operating part 118 is engaged with the shutter unit 87 of the corresponding developing unit 37, thereby coupling the operating part 118 with the shutter unit 87 (process shutter 83).

Since the toner shutter 112 is coupled with the process shutter 83, as described above (see FIG. 6A), the operating part 118 is coupled with the toner shutter 112 via the process shutter 83 when the toner box 24 is mounted in the process cartridge 16.

The pawl 123 provided in the left surface of the operating part 118 (see FIG. 8E) contacts the right side surface of the right rotating plate 88 provided in the shutter unit 87 at a position lower than the right protruding part 93 so that the pawl 123 is completely accommodated in the recessed part 122 (see FIG. 8E) and does not catch on the curved wall 103 (not illustrated in the drawings). In this state, the operating part 118 in the rearward position can be rotated counterclockwise in a right side view.

When the operating part 118 is in the rearward position and the toner box 24 is mounted in the process cartridge 16, the operating part 118 can be rotated counterclockwise in a right side view. At this time, the shutter unit 87 coupled with the operating part 118 receives a drive force produced by rotating the operating part 118 via the rack gear 96. As a result, the shutter unit 87 rotates clockwise in a right side view about the support shaft 97 of the lower case 18 (the reference line X described above).

As the shutter unit 87 rotates clockwise in a right side view, the process shutter 83 of the shutter unit 87 and the toner shutter 112 coupled to the process shutter 83 rotate (slide) clockwise in a right side view. When the operating part 118 reaches the forward position shown in FIG. 5B, the process shutter 83 and the toner shutter 112 have rotated as far as possible clockwise in a right side view and have arrived in their respective open positions, as shown in FIG. 5A. When the process shutter 83 and toner shutter 112 are both in the open position, the supply hole 104 and the through-hole 77 are in communication with each other.

With the operating part 118 in the forward position, the protruding part 94 provided on the right rotating plate 88 of the shutter unit 87 is adjacent to the right side wall 102 of the toner box 24 from the right side thereof. Hence, the toner box 24 mounted in the process cartridge 16 cannot be pulled rightward (cannot be removed), thereby maintaining the mounted state of the toner box 24 in the process cartridge 16.

However, when the operating part 118 in the forward position is rotated clockwise in a right side view, the shutter unit 87 (process shutter 83) and the toner shutter 112 rotate (slide) counterclockwise in a right side view about the support shaft 97 of the lower case 18 (i.e., the reference line X) and are thus returned to their respective closed positions shown in FIG. 6A. As a result, the supply hole 104 and the through-hole 77 are no longer in communication.

Further, the protruding part 94 of the shutter unit 87 rotates together with the rotation of the shutter unit 87 and is thus shifted upward from the toner box 24 in a right side view, as illustrated in FIG. 6B. Consequently, the protruding part 94 is not in the way of the toner box 24 when the toner box 24 is moved rightward, allowing an operator to remove the toner box 24 from the process cartridge 16, as described above.

As described above, the operations of the toner shutter 112 to open and close the supply hole 104 are associated with the operations of the process shutter 83 to open and close the through-hole 77. The image-forming operation described above can be implemented when the toner box 24 is mounted in the process cartridge 16, as shown in FIG. 5A, and the process shutter 83 and toner shutter 112 are both in the open position.

Figures 9A, 9B, 9C, 9D:
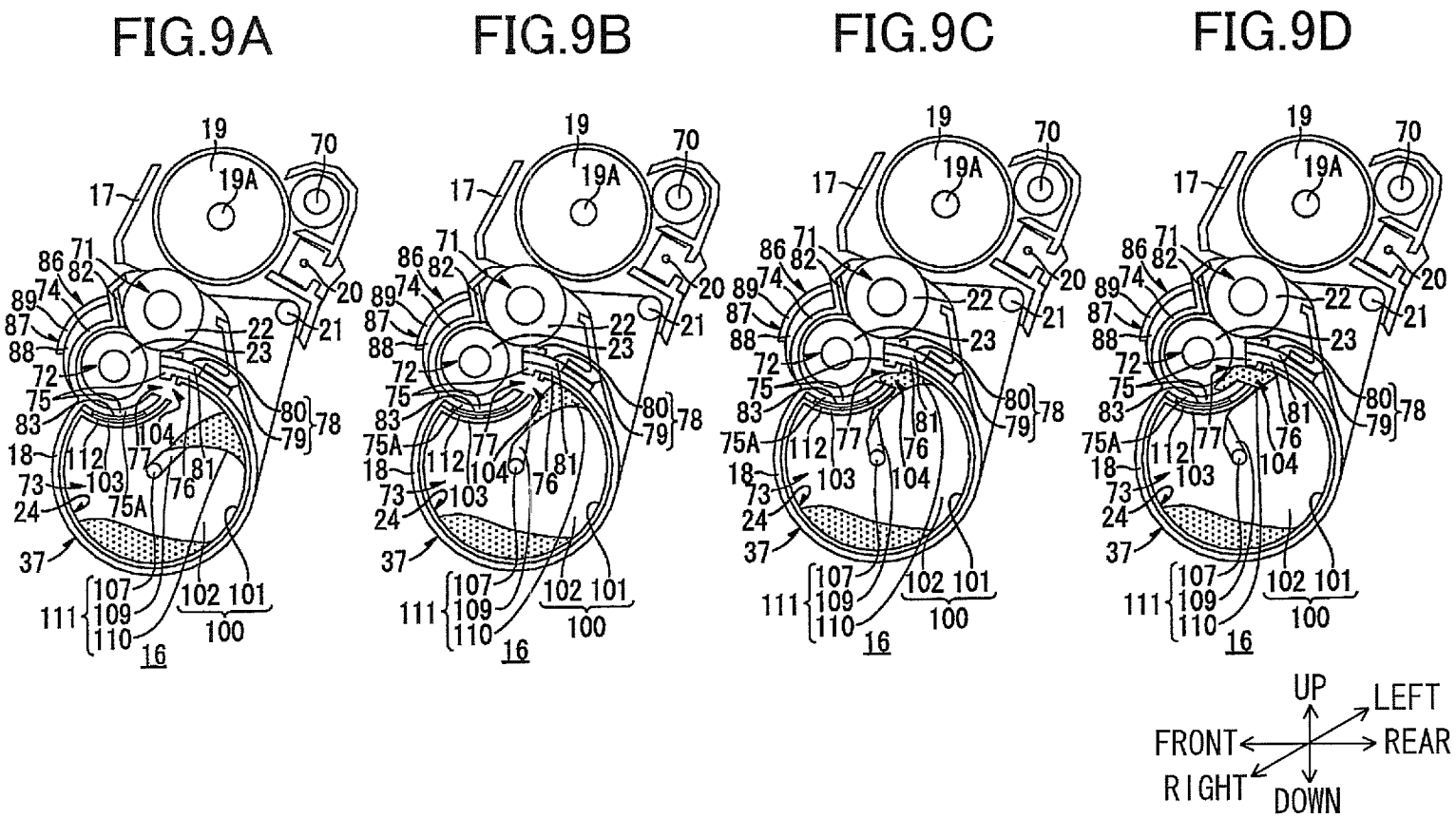
FIG. 9A is a right side cross-sectional view of the process cartridge while rotating an agitator with the toner shutter and the process shutter open.
FIG. 9B is a right side cross-sectional view of the process cartridge after passing a prescribed time from FIG. 9A.
FIG. 9C is a right side cross-sectional view of the process cartridge after passing a prescribed time from FIG. 9B.
FIG. 9D is a right side cross-sectional view of the process cartridge after passing a prescribed time from FIG. 9C.

FIG. 9 is a right side cross-sectional view showing the process cartridge 16 when both the process shutter 83 and toner shutter 112 are in the open position, where FIGS. 9A through 9D show the various rotational states of the agitator 111 over time. As shown in FIG. 9, during an image-forming operation, a drive force from the main casing 2 side is transmitted to the agitator 111 via the input gear 108 (see FIG. 8A) and the coupling gear 85 (see FIG. 5C). This drive force serves to rotate the agitator 111 counterclockwise in a right side view so that the agitator 111 agitates the toner (the dot filled regions indicated in FIG. 9). The rotating path of the support part 109 provided in the agitator 111 is indicated by a dotted line in FIG. 1.

Specifically, the agitating blade 110 of the rotating agitator 111 contacts the inner peripheral surface of the circumferential wall 101 constituting the box casing 100 in a somewhat bowed state and scrapes toner accumulated in the bottom of the box casing 100 upward along the rotating direction of the agitator 111, as illustrated in FIG. 9A. As the agitator 111 continues to rotate, the toner scraped upward by the agitating blade 110 approaches the supply hole 104 from the upstream side (rear side in FIG. 9B) with respect to the rotating direction of the agitator 111 (counterclockwise in a right side view), as illustrated in FIG. 9B.

As the agitator 111 continues to rotate, the agitating blade 110 pushes the toner confronting the supply hole 104, as described above, into the supply hole 104 from the upstream side in the rotating direction of the agitator 111, as illustrated in FIG. 9C. The toner pushed through the supply hole 104 is pushed further inward by successive quantities of toner that the agitating blade 110 pushes through the supply hole 104, as shown in FIG. 9D. Consequently, toner pushed through the supply hole 104 passes through the through-hole 77 in communication with the supply hole 104 enters the supply chamber 72 of the lower case 18 provided in the process cartridge 16, and accumulates on the accumulating part 75A, which is a portion on the top surface of the first protruding wall 75 positioned lower than the through-hole 77.

Thus, in addition to supplying toner into the supply chamber 72, the rotations of the agitator 111 suitably agitate the toner collected in the bottom of the box casing 100. Toner collected in the accumulating part 75A in the supply chamber 72, as described above, is subsequently supplied onto the supply roller 23 provided in the supply chamber 72. Thereafter, the supply roller 23 rotating clockwise in a right side view conveys this toner upward and supplies the toner to the developing roller 22 at the point of contact between the supply roller 23 and developing roller 22.

As the developing roller 22 rotates counterclockwise in a right side view, the toner supplied onto the developing roller 22 is conveyed between the outer peripheral surface of the developing roller 22 and the pressing part 80 on the thickness-regulating blade 78. The pressing part 80 regulates the thickness of toner carried on the outer peripheral surface of the developing roller 22 at a thin layer. This thin layer of toner is subsequently supplied to the photosensitive drum 19.

When more than the required amount of toner collects on the accumulating part 75A of the first protruding wall 75, the excess toner is shifted from the accumulating part 75A to the through-hole 77, sequentially passes through the through-hole 77 and the supply hole 104 and returns to the toner box 24. Hence, the toner circulates between the toner box 24 and the accumulating part 75A of the first protruding wall 75.

When both the process shutter 83 and the toner shutter 112 are in the open position, as described above, toner can move between the toner box 24 and the corresponding photosensitive drum 19. However, when the process shutter 83 and toner shutter 112 are both in the closed position, as shown in FIG. 6A, toner cannot move between the toner box 24 and the photosensitive drum 19 since both the supply hole 104 and the through-hole 77 are closed.

In this way, the process shutter 83 and the toner shutter 112 open and close between the toner box 24 and the corresponding photosensitive drum 19 to allow or restrict the movement of toner therebetween. The operating part 118 of the toner box 24 (see FIG. 6B) is operated in order to open and close the process shutter 83 and toner shutter 112.

(3) Mounting and Removal of the Process Cartridges (Toner Boxes) with Respect to the Drawer Frame Next, operations for mounting the process cartridges 16 in and removing the process cartridges 16 from the drawer frame 15 of the drawer unit 14 will be described. The following description will assume that the drawer unit 14 is outside of the main casing 2.

The process cartridge 16 is placed above the drawer frame 15, as shown in FIG. 4. The front-to-rear position of the process cartridge 16 with respect to the drawer frame 15 (see FIG. 1) differs according to the color of toner accommodated in the toner box 24 of the process cartridge 16. Therefore, the process cartridge 16 is disposed at a prescribed position in the front-to-rear direction above the drawer frame 15.

At this time, the corresponding left and right guiding grooves 60 in the drawer frame 15 are positioned below the process cartridge 16. The process cartridge 16 is inserted into the drawer frame 15 by lowering the process cartridge 16 through the opening 15A formed in the top of the drawer frame 15. When the process cartridge 16 has been lowered a certain amount, the guiding grooves 60 receive the corresponding widthwise ends of the central shaft 19A provided in the photosensitive drum 19 of the process cartridge 16. As the central shaft 19A of the photosensitive drum 19 is guided in the guiding grooves 60, the process cartridge 16 proceeds downward at a forward slant that follows the extended direction of the guiding grooves 60.

When the central shaft 19A of the photosensitive drum 19 arrives at the deepest point (bottom) of the guiding grooves 60, as illustrated by the forwardmost process cartridge 16 in FIG. 4, the downward movement of the process cartridge 16 stops and the operation for mounting the process cartridge 16 in the drawer frame 15 is complete. Assembly of the drawer unit 14 is complete when all process cartridges 16 have been mounted in the drawer frame 15 according to the procedure described above. In this state, the drawer frame 15 supports the four process cartridges 16 (i.e., the four photosensitive drums 19 and developing units 37).

When mounting of the process cartridge 16 in the drawer frame 15 is complete, the entire right side surface of the toner box 24 in the process cartridge 16 is exposed outside the drawer frame 15 through the circular exposure holes 15C formed in the right wall of the drawer frame 15 at the same position as the toner box 24 with respect to the front-to-rear direction. Hence, the operator can manipulate the grip part 119 on the operating part 118 of the toner box 24 exposed through the circular exposure holes 15C when the process cartridge 16 is mounted in the drawer frame 15 in order to move the process shutter 83 and toner shutter 112 between the open and closed positions, as described above (see FIGS. 5 and 6).

Further, by gripping the grip part 119 provided on the operating part 118 that is exposed in the circular exposure holes 15C, the operator can pull the toner box 24 through the circular exposure holes 15C and extract the toner box 24 from the process cartridge 16 (i.e., from the drawer frame 15).

Conversely, by inserting the toner box 24 through the circular exposure holes 15C formed on the right side of the drawer frame 15 and thus through the box-mounting opening 84 in the corresponding process cartridge 16 (see FIG. 6C) so that the toner box 24 is accommodated in the box-accommodating chamber 73, the operator can mount the toner box 24 in the process cartridge 16 (i.e., the drawer frame 15).

In this way, the operator can move the toner box 24 along the width direction through the circular exposure holes 15C while the process cartridge 16 is mounted in the drawer frame 15 in order to remove only the toner box 24 from or mount only the toner box 24 in the drawer unit 14.

Further, when the operator pulls a process cartridge 16 that is mounted in the drawer frame 15 upward until the entire process cartridge 16 is lifted above the opening 15A formed in the top of the drawer frame 15, removal of the process cartridge 16 from the drawer frame 15 is complete.

4. Mounting and Removal of the Drawer Unit Relative to the Main Casing

Next, the procedure for mounting the drawer unit 14 in and removing the drawer unit 14 from the main casing 2 will be described.

While the drawer unit 14 is not mounted in the main casing 2, as illustrated in FIG. 3, the operator first pivots the pivoting unit 52 upward and subsequently rotates the second front cover 50 downward on the front side to expose the unit-mounting opening 49, as described above. Next, the operator inserts the drawer unit 14 through the unit-mounting opening 49 into the unit-accommodating chamber 40. The drawer unit 14 is inserted substantially horizontally along the guide parts 42.

When inserting the drawer unit 14 into the unit-accommodating chamber 40, the wheels 64 on the rear end of the drawer unit 14 roll over the first guiding roller 43 (see FIG. 2), first sloped wall 44 (see FIG. 2), and first guiding rail 45 of the corresponding guide part 42 (i.e., the guide part 42 on the same widthwise side) as the drawer unit 14 progresses rearward. When the wheels 64 reach the corresponding first guiding rails 45, the flanges 62 of the drawer unit 14 (see FIG. 4) come to rest on the corresponding first guiding rollers 43 (see FIG. 2).

Thus, as the drawer unit 14 progresses rearward, the wheels 64 roll over the first guiding rails 45 while the flanges 62 (see FIG. 4) slide rearward over the rolling first guiding rollers 43 (see FIG. 2). Accordingly, the drawer unit 14 moves rearward in a stable state. Subsequently, the wheels 64 on the drawer unit 14 roll over the second guiding rollers 46, second sloped walls 47, and second guiding rails 48 before coming to a halt at the curved rear ends of the second guiding rails 48. Thus, the drawer unit 14 moves diagonally downward and rearward while remaining in a level state before halting in the position shown in FIG. 2.

Through this process, the drawer unit 14 is mounted in the main casing 2. At this time, the positioning shafts 61 on the drawer frame 15 contact the main casing 2 (more specifically the partitioning wall 41), which contact further fixes the position of the drawer unit 14 relative to the main casing 2.

Next, the operator closes the second front cover 50 by rotating the second front cover 50 upward and closes the pivoting unit 52 by pivoting the pivoting unit 52 downward, as shown in FIG. 1. Through this operation, the intermediate transfer belt 27 of the transfer unit 12 contacts the tops of the photosensitive drums 19 provided in the drawer unit 14.

To remove the drawer unit 14 from the main casing 2, the operator sequentially opens the pivoting unit 52 and second front cover 50 to expose the unit-mounting opening 49, as shown in FIG. 2, and subsequently pulls the drawer unit 14 forward through the unit-mounting opening 49 (see FIG. 3).

The drawer unit 14 is completely removed from the main casing 2 when the operator has pulled the drawer unit 14 forward in a substantially level state until the four circular exposure holes 15C formed in the right side wall of the drawer frame 15 are exposed on the right side, as shown in FIG. 4. Thus, the drawer unit 14 (drawer frame 15) can be removed from the main casing 2 along the front-to-rear direction (the juxtaposed direction of the four photosensitive drums 19 shown in FIGS. 1 through 3).

While the drawer unit 14 (drawer frame 15) is pulled out of the main casing 2 in this way, the operator can remove toner boxes 24 from or insert toner boxes 24 into the process cartridges 16 (developing units 37) supported in the drawer unit 14 through the corresponding circular exposure holes 15C of the drawer frame 15 along the width direction, as described above. Further, by manipulating the operating part 118 of each toner box 24 in this state, the operator can move the process shutter 83 and toner shutter 112 between their respective open and closed positions (see FIGS. 5 and 6).

5. Effects of the first embodiment (1) In the toner box 24 shown in FIG. 9, the agitator 111 is disposed inside the box casing 100, which serves to accommodate toner. The agitator 111 agitates toner in the box casing 100 by rotating about its agitator shaft 107 extending in the width direction.

As described above, the box casing 100 has the curved wall 103. The curved wall 103 curves in an arc shape whose convex side faces the interior of the box casing 100 (see FIG. 5C). The center of curvature of the curved wall 103 is the reference line X. Therefore, when the agitator 111 rotates inside the box casing 100, the agitating blade 110 can contact and pass over the curved wall 103 protruding into the box casing 100.

The supply hole 104 is formed in the upstream side of the curved wall 103 with respect to the rotating direction of the agitator 111 (the counterclockwise direction in a right side view) to provide communication between the interior and exterior of the box casing 100. Accordingly, the supply hole 104 through which toner accommodated in the box casing 100 passes when expelling the toner outside of the toner box 24 can be disposed along the rotating path of the agitator 111 so as to oppose the rotating agitator 111 on the downstream side with respect to the rotating direction of the agitator 111.

As a result, toner conveyed by the rotating agitator 111 in the rotating direction thereof is efficiently supplied to the supply hole 104. Hence, the configuration of the toner box 24 enables toner accommodated in the box casing 100 to be efficiently expelled therefrom.

(2) Since the toner shutter 112 moves along the circumferential direction of the curved wall 103 in order to open and close the supply hole 104 (see FIGS. 8A through 8D), the toner shutter 112 can appropriately allow or restrict the passage of toner through the supply hole 104.

(3) The agitator 111 includes the support part 109 formed of a hard material and extending radially outward from the agitator shaft 107, and the flexible agitating blade 110 that is supported on the support part 109 and extends radially outward therefrom.

With this construction, the agitating blade 110 supported on the support part 109 bows a suitable amount when the agitator 111 rotates in order to convey a large amount of toner in the rotating direction of the agitator 111. Since the agitating blade 110 also flexes a suitable amount when passing over the curved wall 103 (see FIG. 9D), the agitating blade 110 does not get caught on the curved wall 103, enabling the agitator 111 to rotate smoothly.

(4) Since the cross section of the box casing 100 when viewed along the width direction is substantially circular in shape and substantially matches the rotating path of the agitator 111, the agitator 111 can convey toner within the box casing 100 in the rotating direction of the agitator 111 without toner leaking around the agitator 111. Accordingly, the agitator 111 can convey toner to the supply hole 104 with even better efficiency and can agitate all of the toner within the box casing 100 thoroughly.

(5) As shown in FIG. 8, the toner shutter 112 is supported by the box casing 100 at a plurality of locations along the width direction. Therefore, the toner shutter 112 can open and close the supply hole 104 in a more stable state than when the toner shutter 112 is supported at only one location.

(6) As shown in FIG. 9, the developing unit 37 includes the toner box 24, and the lower case 18 in which the toner box 24 is detachably mounted, as described above.

The first protruding wall 75 is disposed in the lower case 18 opposite the curved wall 103 of the toner box 24 and curves in an arc shape that conforms with the shape of the curved wall 103. That is, the first protruding wall 75 protrudes in an arc shape toward the curved wall 103 of the toner box 24.

The lower case 18 supports the developing roller 22, which carries toner to be supplied to an electrostatic latent image, and the supply roller 23, which supplies toner from the toner box 24 to the developing roller 22 in the developing unit 37 described above.

The supply roller 23 is supported in the lower case 18 such that the outer peripheral surface of the supply roller 23 follows the first protruding wall 75 and the curved wall 103. The supply roller 23 can be compactly disposed in the developing unit 37 so as to fit within the inner region of the first protruding wall 75, thereby enabling the entire developing unit 37 to be made more compact (smaller vertically in this case).

(7) In the developing unit 37 described above, the through-hole 77 is formed in the first protruding wall 75 at a position confronting the supply roller 23 opposite the supply hole 104 of the toner box 24. The process shutter 83 is provided to open and close the through-hole 77. Hence, when the process shutter 83 opens the through-hole 77 while the supply hole 104 is open, toner is allowed to move between the toner box 24 and supply roller 23 (see FIG. 5A). When the process shutter 83 closes the through-hole 77, toner is restricted from moving between the toner box 24 and supply roller 23 (see FIG. 6A).

(8) The support member 86 is provided in the lower case 18 of the developing unit 37 (see FIG. 7). The support member 86 can freely rotate about the reference line X that extends in the width direction and passes through the center of curvature of the curved wall 103 (see FIGS. 5B and 6B).

The rotational center of the support member 86 is the reference line X. Since the process shutter 83 is integrally formed with the support member 86, the rigidity of the entire shutter unit 87 is enhanced. Since the process shutter 83 is supported on the support member 86 (see FIG. 7), the process shutter 83 can be rotated to open and close the through-hole 77 through the simple operation of rotating the support member 86 (see FIGS. 5A and 6A)

(9) As shown in FIG. 8, the operating part 118 engaged with the support member 86 is provided on the toner box 24 (see FIGS. 5B and 6B). Hence, the operator can easily rotate the support member 86 and process shutter 83 by operating the operating part 118 in order to open and close the through-hole 77 (see FIGS. 5A and 6A).

(10) When the toner box 24 is mounted in the lower case 18, as shown in FIG. 6, the left protrusions 114 of the toner shutter 112 are engaged in the left recess parts 92 of the process shutter 83 and the right protrusions 116 of the toner shutter 112 are engaged in the right recessed parts 95 of the process shutter 83 (see FIGS. 6C, 8A, and 8B). In this way, the operations of the toner shutter 112 to open and close the supply hole 104 are associated with the operations of the process shutter 83 to open and close the through-hole 77. Hence, both the supply hole 104 and through-hole 77 can be opened and closed together, thereby simplifying the operation.

(11) As shown in FIG. 9, the supply roller 23 is disposed at a higher position than the toner box 24. Accordingly, toner accommodated in the toner box 24 must be conveyed upward to be supplied to the supply roller 23.

However, with the toner box 24 of the preferred embodiment, the toner accommodated in the box casing 100 can be efficiently supplied to the supply roller 23 through the supply hole 104 formed in the toner box 24, even though the toner is being supplied upward, because the supply hole 104 is formed at a position upstream of the curved wall 103 with respect to the rotating direction of the agitator 111.

(12) The first protruding wall 75 provided in the developing unit 37 is arc-shaped with the convex side on the bottom. With this configuration, the accumulating part 75A is formed in the top of the first protruding wall 75 at a position lower than the bottom end of the through-hole 77.

Therefore, when toner accommodated in the box casing 100 of the toner box 24 is conveyed upward through the supply hole 104 and arrives at the through-hole 77, rather than falling back into the box casing 100, the toner accumulates in the accumulating part 75A of the first protruding wall 75, which is adjacent to the supply roller 23 and positioned lower than the bottom edge of the through-hole 77 (see FIG. 9D). Accordingly, toner can be efficiently supplied to the supply roller 23.

(13) In the color printer 1 shown in FIG. 1, a plurality of developing units 37 is disposed beneath the plurality of photosensitive drums 19 juxtaposed horizontally for developing electrostatic latent images formed on the corresponding photosensitive drums 19. Thus, each of the developing units 37 is disposed beneath a corresponding photosensitive drum 19. The drawer frame 15 provided for supporting the plurality of photosensitive drums 19 and developing units 37 is disposed in the main casing 2 of the color printer 1 and can be pulled out from the main casing 2 along the juxtaposed direction of the photosensitive drums 19 (see FIG. 3).

The toner box 24 is also disposed in each developing unit 37 for accommodating toner needed to develop the electrostatic latent image on the corresponding photosensitive drum 19.

As shown in FIG. 4, the toner boxes 24 can be mounted in and removed from the corresponding developing units 37 supported in the drawer frame 15 along the axial direction of the photosensitive drums 19 (width direction) while the drawer frame 15 is pulled out of the main casing 2. In this way, the toner boxes 24 can be easily mounted in and removed from the developing units 37 without troubling the operator to perform such operations as removing the photosensitive drums 19 above the developing units 37.

This construction has the effect of improving the ease of maintaining the toner boxes 24 provided in the developing units 37 when the developing units 37 are disposed beneath the photosensitive drums 19 juxtaposed in a horizontal direction.

(14) With the color printer 1 of the preferred embodiment, the process shutter 83 and toner shutter 112 shown in FIGS. 5A and 6A allow or restrict the movement of toner by opening and closing the passage between the toner boxes 24 and corresponding photosensitive drums 19.

The operating part 118 is provided on the upstream side (right side surface) of the toner box 24 with respect to the mounting direction in which the toner box 24 is mounted in the corresponding developing unit 37 (leftward and also referred as the "mounting direction" hereafter) in order to open and close the process shutter 83 and toner shutter 112. Hence, by operating the operating part 118 disposed on the upstream side of the toner box 24 with respect to the mounting direction, i.e., in an easily accessible location, the operator can easily open the shutters (see FIGS. 5 and 6).

The input gear 108 is provided on the downstream side (left side surface) of the toner box 24 with respect to the mounting direction (see FIGS. 8A and 8B). The input gear 108 is coupled to the main casing 2 (more accurately, to the coupling gear 85 provided on the left side wall of the lower case 18; see FIG. 6C) in order to receive a drive force from the main casing 2 and transmit this force to the agitator 111.

Accordingly, as illustrated in FIG. 6, the input gear 108 can be coupled with the main casing 2 (strictly speaking, the coupling gear 85; see FIG. 6C) when the toner box 24 is completely mounted in the developing unit 37. With this construction, the toner box 24 can be more smoothly mounted in the developing unit 37 than when the input gear 108 couples with the main casing 2 while the toner box 24 is partially mounted in the developing unit 37. Further, by providing the input gear 108 on the downstream side of the toner box 24 with respect to the mounting direction, sufficient space can be allocated for the operating part 118 provided on the upstream side of the toner box 24 with respect to the mounting direction (see FIG. 8A).

(15) The first protruding wall 75 provided in each developing unit 37 arcs downward so that the top portion of the first protruding wall 75 (the accumulating part 75A) is positioned lower than the bottom edge of the through-hole 77.

Therefore, when toner accommodated in the box casing 100 of the toner box 24 is conveyed upward through the supply hole 104 and arrives at the through-hole 77, rather than falling back down into the box casing 100, the toner accumulates in the accumulating part 75A of the first protruding wall 75 at a position adjacent to the supply roller 23 and lower than the bottom edge of the through-hole 77 (see FIG. 9D). Accordingly, toner can be efficiently supplied to the supply roller 23.

6. Variations of the First Embodiment

Figure 10:
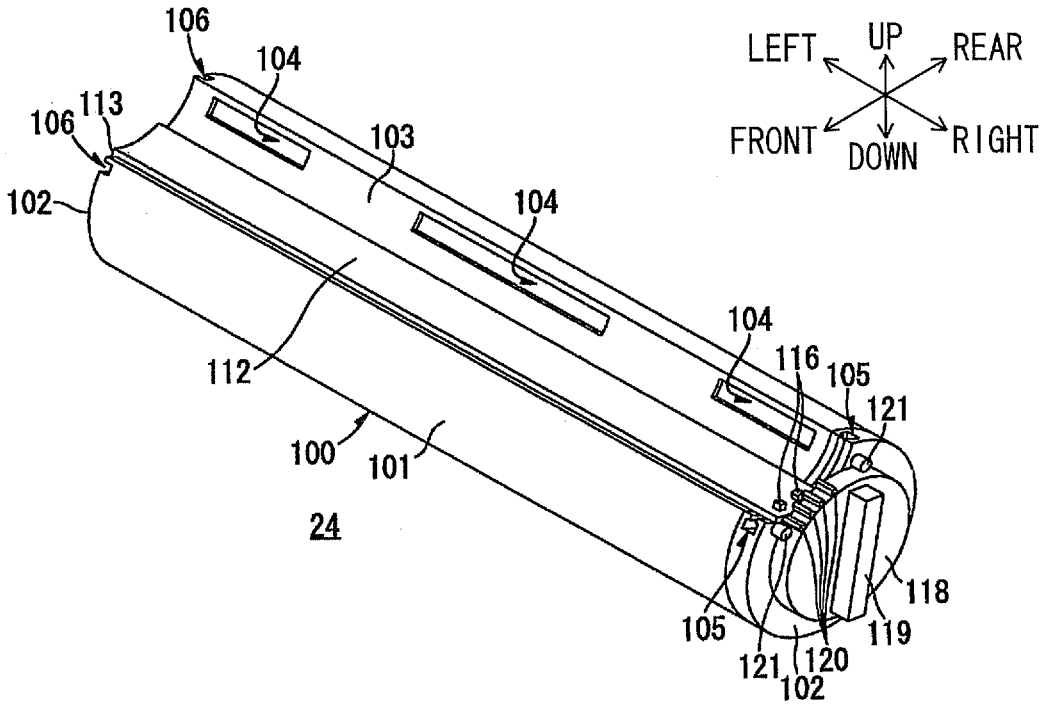
FIG. 10 is a perspective view of a toner box as viewed from right-front side according to a modification of the first embodiment.

FIG. 10 shows a modification of the first embodiment applied to the toner box 24 in FIG. 8D.

In the preferred embodiment described above, a single supply hole 104 is formed in the curved wall 103 of the toner box 24 (see FIG. 8D). However, a plurality of supply holes 104 may be formed in the curved wall 103, as in the variation shown in FIG. 10. In this case, the through-hole 77 in the process cartridge 16 (see FIG. 9) should also be formed as a plurality of through-holes 77 equivalent to the number of supply holes 104 and formed at a position where the plurality of supply holes 104 confronts when the toner box 24 is mounted in the process cartridge 16. In the example shown in FIG. 10, three supply holes 104 are aligned in the width direction. The widthwise dimension of each supply hole 104 is approximately one-third that of the single supply hole 104 provided in the first embodiment (see FIG. 8D).

With this construction, toner within the toner box 24 (box casing 100) is supplied into the supply chamber 72 of the process cartridge 16 (see FIG. 9) via the center supply hole 104 and the center through-hole 77. Toner supplied into the supply chamber 72 that is not supplied onto the supply roller 23 falls by its own weight sequentially through the two through-holes 77 on the widthwise ends and the two supply holes 104 on the widthwise ends, and is returned to the toner box 24.

In this way, toner is circulated between the toner box 24 and supply chamber 72. In this example, a seal (not shown) may also be provided in the toner box 24 to prevent toner from leaking through the supply holes 104 between the curved wall 103, in which the supply holes 104 are formed, and the toner shutter 112. Generally, the seal is provided to fringe the edges of the supply holes 104 (not illustrated in the drawings).

If the size of each supply hole 104 is reduced by providing a plurality of supply holes 104, as in the present modification, the amount of sealing material required to fringe the supply holes 104 can be reduced. Reducing the amount of required sealing material reduces the resistance generated when the toner shutter 112 slides against the seal. Thus, the toner shutter 112 slides more smoothly.

7. Second Embodiment

Next, a laser printer 201 according to a second embodiment of the present invention will be described while referring to FIGS. 11 through 19. Before describing the features of the present invention, a brief description will be given for the general structure of the laser printer 201.

8. General Structure of the Laser Printer

Figure 11:
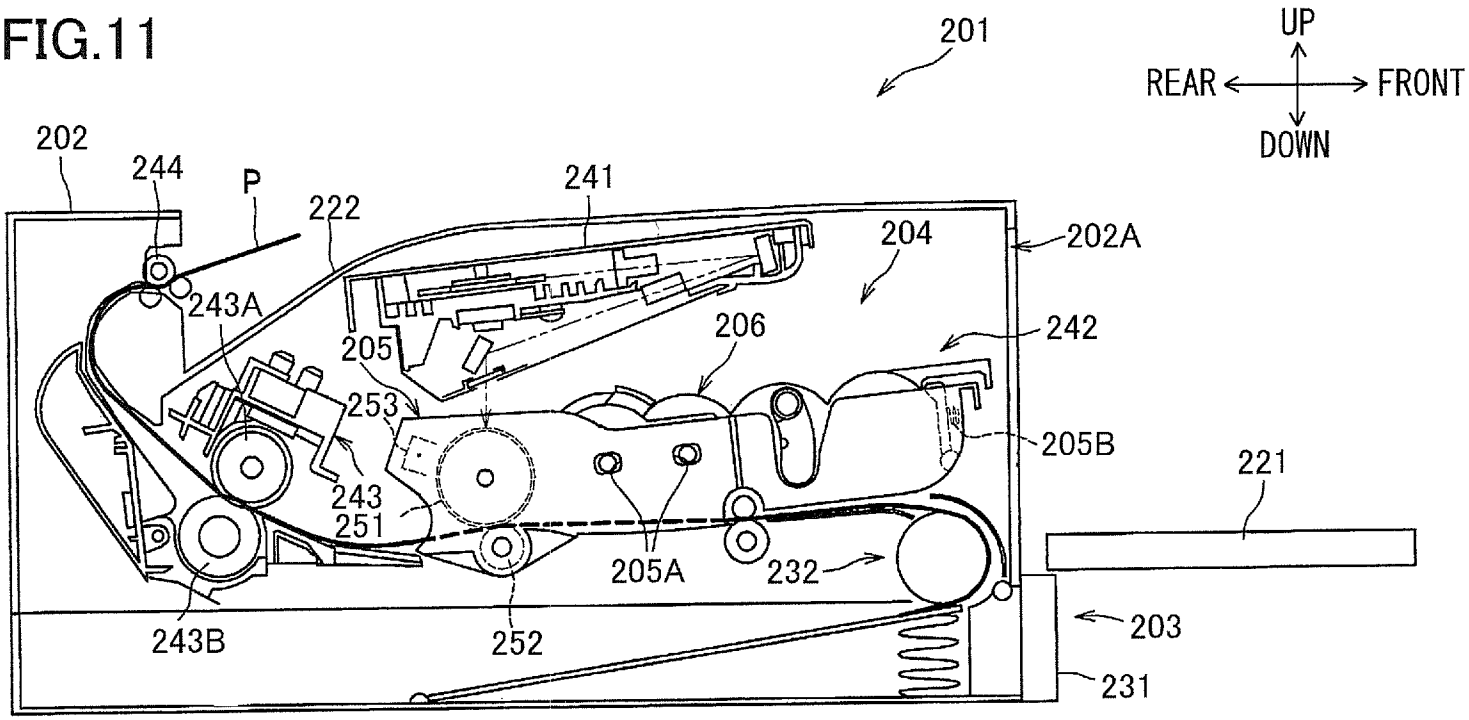
FIG. 11 is a schematic cross-sectional view of a laser printer provided with a developing unit according to a second embodiment of the present invention.

As shown in FIG. 11, the laser printer 201 includes a main casing 202, a feeding unit 203, and an image-forming unit 204.

The main casing 202 is formed in a hollow box shape and includes an opening 202A formed in the front wall thereof, and a front cover 221 disposed on the front wall and capable of pivoting forward and rearward to open and close the opening 202A. The top surface of the main casing 202 is configured as a discharge tray 222 for receiving and holding sheets of a paper P after printing.

The feeding unit 203 includes a paper tray 231 and a feeding mechanism 232. The feeding mechanism 232 of the feeding unit 203 separates and conveys the paper P accommodated in the paper tray 231 one sheet at a time to the image-forming unit 204. The image-forming unit 204 includes a scanning unit 241, a process cartridge 242, and a fixing unit 243.

The scanning unit 241 has a well-known construction that includes primarily a laser light-emitting unit (not shown), as well as a polygon mirror and a plurality of lenses and reflecting mirrors (not denoted with reference numerals in the drawings). The laser beam emitted from the laser light-emitting unit follows a path within the scanning unit 241 indicated by a two-dot chain line in FIG. 11 and is irradiated in a high-speed scan over the surface of a photosensitive drum 251 provided in the process cartridge 242.

The process cartridge 242 is detachably mounted in the main casing 202 when the front cover 221 is opened. The process cartridge 242 includes a process cartridge 205, and a developing unit 206 pivotably held by the process cartridge 205.

The process cartridge 205 includes the photosensitive drum 251, a transfer roller 252, and a Scorotron charger 253.

Figure 12:
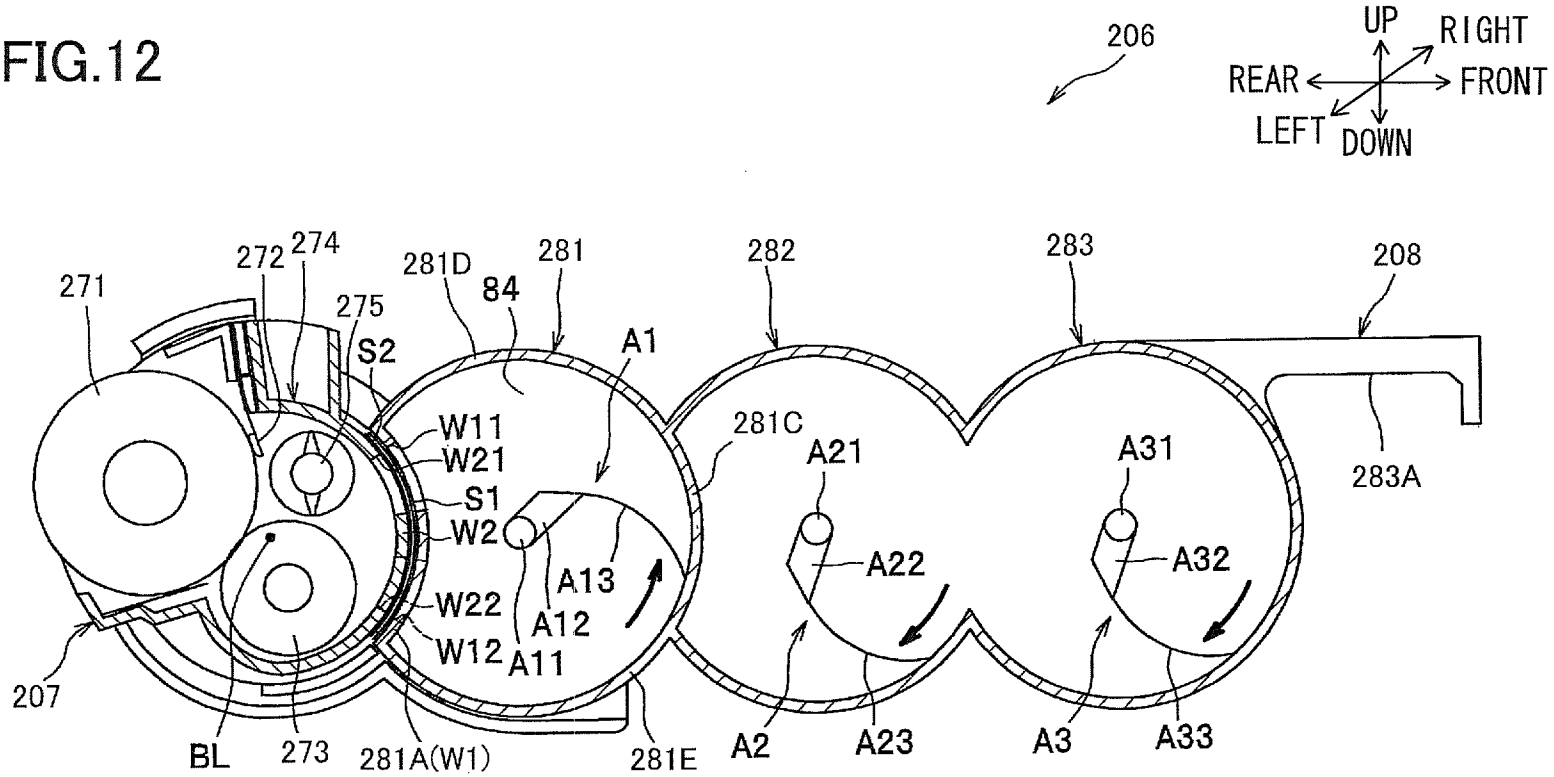
FIG. 12 is a schematic cross-sectional view of the developing unit.

As shown in FIG. 12, the developing unit 206 includes a developing device 207, and a toner cartridge 208 that is detachably mounted on the developing device 207. When mounted on the process cartridge 205, the developing unit 206 is supported on the side walls of the process cartridge 205 and is capable of moving in the front-to-rear direction within elongated holes 205A formed in the side walls. The developing unit 206 is also pressed against the photosensitive drum 251 by springs 205B that urge the developing unit 206 rearward via the toner cartridge 208 (see FIG. 12).

The developing device 207 includes a developing roller 271, a thickness-regulating blade 272, and a supply roller 273. The toner cartridge 208 accommodates toner internally and is capable of conveying this toner to the developing device 207. The developing device 207 and toner cartridge 208 will be described later in greater detail.

With the process cartridge 242 having this construction, the toner cartridge 208 conveys toner into the developing device 207, and the supply roller 273 of the developing device 207 supplies this toner onto the developing roller 271, at which time the toner is positively tribocharged between the supply roller 273 and developing roller 271. As the developing roller 271 rotates, the toner carried on the surface of the developing roller 271 passes between the thickness-regulating blade 272 and developing roller 271, at which time the thickness-regulating blade 272 regulates the layer of toner carried on the surface of the developing roller 271 to a prescribed thickness.

In the meantime, in the process cartridge 205 shown in FIG. 11, the Scorotron charger 253 applies a uniform positive charge to the surface of the photosensitive drum 251, after which the scanning unit 241 irradiates a laser beam in a high-speed scan to form an electrostatic latent image on the surface of the photosensitive drum 251 based on image data by reducing the electric potential in exposed areas. Next, the rotating developing roller 271 supplies toner to the electrostatic latent image formed on the surface of the photosensitive drum 251 as the toner carried on the developing roller 271 rotates into and contacts the photosensitive drum 251.

In this way, toner selectively attracted to the surface of the photosensitive drum 251 develops the latent image into a visible toner image through reverse development. Thereafter, the toner image carried on the surface of the photosensitive drum 251 is transferred onto a sheet of paper P as the sheet is conveyed between the photosensitive drum 251 and transfer roller 252.

The fixing unit 243 includes a heating roller 243A and a pressure roller 243B. The fixing unit 243 functions to fix toner transferred to a sheet of paper P with heat as the sheet passes between the heating roller 243A and pressure roller 243B. After the toner image has been fixed to the sheet in the fixing unit 243, discharge rollers 244 disposed downstream of the fixing unit 243 discharge the sheet onto the discharge tray 222.

9. Structure of the Developing Unit

Next, the developing device 207 and toner cartridge 208 constituting the developing unit 206 will be described in greater detail. First, a description of the toner cartridge 208 will be given.

10. Structure of the Toner Cartridge

As shown in FIG. 12, the toner cartridge 208 is provided with a first accommodating unit 281, a second accommodating unit 282, and a third accommodating unit 283 that each accommodate toner. The toner cartridge 208 also has a grip part 283A that protrudes forward from the third accommodating unit 283.

When the toner cartridge 208 is mounted on the developing device 207 (and specifically when the developing unit 206 is mounted in the main casing 202), the first accommodating unit 281 is positioned adjacent to the developing device 207 in a horizontal direction. The first accommodating unit 281 is formed in a substantially hollow cylindrical shape. Among the walls constituting the first accommodating unit 281 is an adjoining wall 281A adjoined with the developing device 207. The adjoining wall 281A has a concave shape that is depressed toward the interior of the first accommodating unit 281.

More specifically, the adjoining wall 281A is curved in an arc shape in a cross-sectional view. The center of the arc shape is a reference line BL (the rotational center of a process shutter S2 described later with reference to FIGS. 18 and 19) provided rearward (outside) of the first accommodating unit 281 and extending in the left-to-right direction (parallel to the rotational axis of an agitating member described later. For convenience, the adjoining wall 281A will also be referred to as a "first arc wall W1" in the following description.

Figure 13:
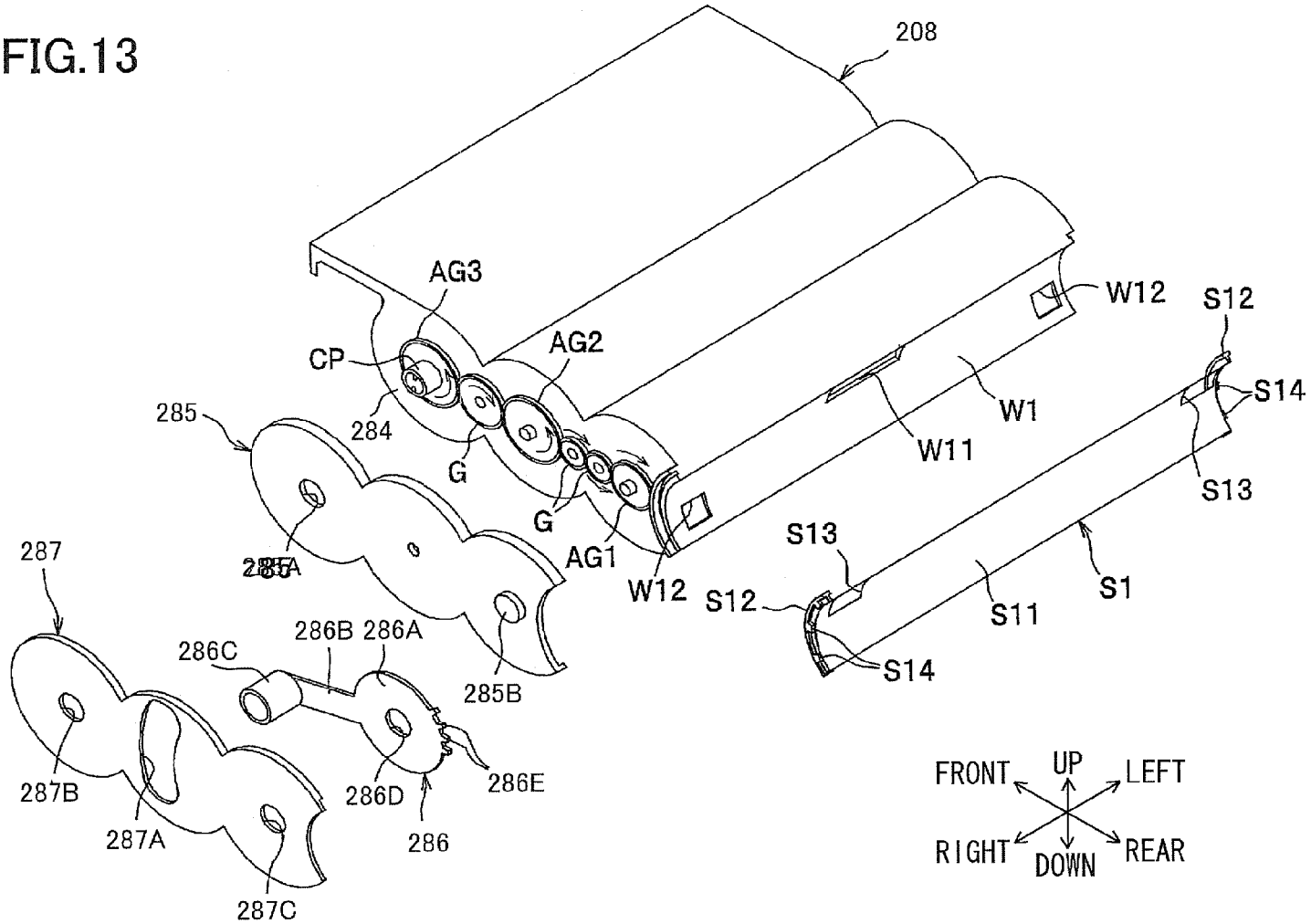
FIG. 13 is an exploded perspective view of a toner cartridge as viewed from right-front side.

As shown in FIG. 13, a first supply hole W11 and second supply holes W12 are formed in the first arc wall W1 so as to penetrate the interior of the first accommodating unit 281.

A single first supply hole W11 is formed in the upper half of the first arc wall W1 at a position in the left-to-right center thereof. The two second supply holes W12 are formed in the lower half of the first arc wall W1, with one positioned at each of the left and right ends thereof. Hence, the second supply holes W12 are offset from the first supply hole W11 both in the left-to-right direction and the vertical direction.

By forming the first supply hole W11 in the top half of the first arc wall W1, the first supply hole W11 is disposed above the second supply hole W12 and provides communication in a downward slope from the first accommodating unit 281 to the developing device 207. Further, by forming the second supply holes W12 in the lower half of the first arc wall W1, the second supply holes W12 are disposed lower than the first supply hole W11 and provide communication in an upward slope from the first accommodating unit 281 to the developing device 207.

Figure 14A:
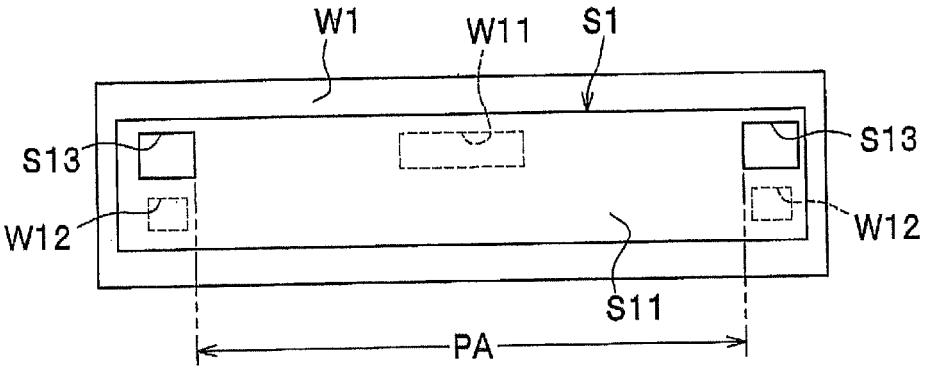
FIG. 14A is a schematic illustration of a relationship among a toner shutter, a first supply hole, and a second supply hole in a state in which the toner shutter is close.

Further, the second supply holes W12 are both positioned outside of a printing area PA (see FIG. 14A). The printing area PA denotes the maximum width (length in a direction orthogonal to the conveying direction of the paper P) for a toner image to be transferred onto the paper P. Providing the second supply holes W12 outside of the printing area PA in this way suppresses the accumulation of toner in the developing device 207 outside of the printing area PA.

As shown in FIG. 13, a toner shutter S1 is disposed on the rear side of the first arc wall W1. The toner shutter S1 opens and closes the first supply hole W11 and second supply holes W12 by moving along the circumference of the first arc wall W1. The toner shutter S1 includes a thin metal plate S11 formed in an arc shape that conforms to the first arc wall W1, and a pair of sliding pieces S12 disposed one on each of the left and right ends of the metal plate S11.

An opening S13 that is larger than each of the second supply holes W12 is formed one on each of the left and right sides of the metal plate S11 in the upper half thereof. When the toner shutter S1 is in the closed position shown in FIG. 14A, the first supply hole W11 is closed by a region of the metal plate S11 between the openings S13, and the second supply holes W12 are closed by regions of the metal plate S11 below the respective openings S13.

Figure 14B:
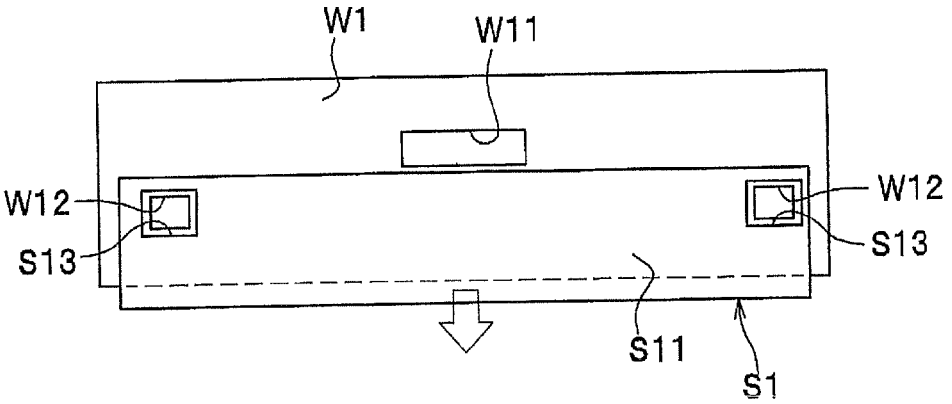
FIG. 14B is a schematic illustration of a relationship among the toner shutter, the first supply hole, and the second supply hole in a state in which the toner shutter is open.

When the toner shutter S1 is moved downward from this closed position to the open position, as shown in FIG. 14B, the top edge of the S11 is moved lower than the first supply hole W11, thereby opening the first supply hole W11, and the openings S13 are positioned overlapping the second supply holes W12, thereby opening the second supply holes W12.

As shown in FIG. 13, the sliding pieces S12 are slidably supported on the toner cartridge 208. A plurality of protrusions S14 is formed on each sliding piece S12. The protrusions S14 protruding frontward engage with a plurality of depressions S23 (see FIG. 18) formed in engaging plates S22 of a process shutter S2 described later.

As shown in FIG. 12, a single first agitator A1 is provided in the first accommodating unit 281. The first agitator A1 rotates in the first accommodating unit 281 so as to scrape over the first arc wall W1 in a direction from top to bottom (counterclockwise in FIG. 12). The first agitator A1 is configured of a rotational shaft A11 rotatably supported in side walls 284 constituting the left and right walls of the toner cartridge 208 (first accommodating unit 281), a support part A12 extending radially outward from the rotational shaft A11, and an agitating blade A13 supported on the support part A12.

Figure 15:
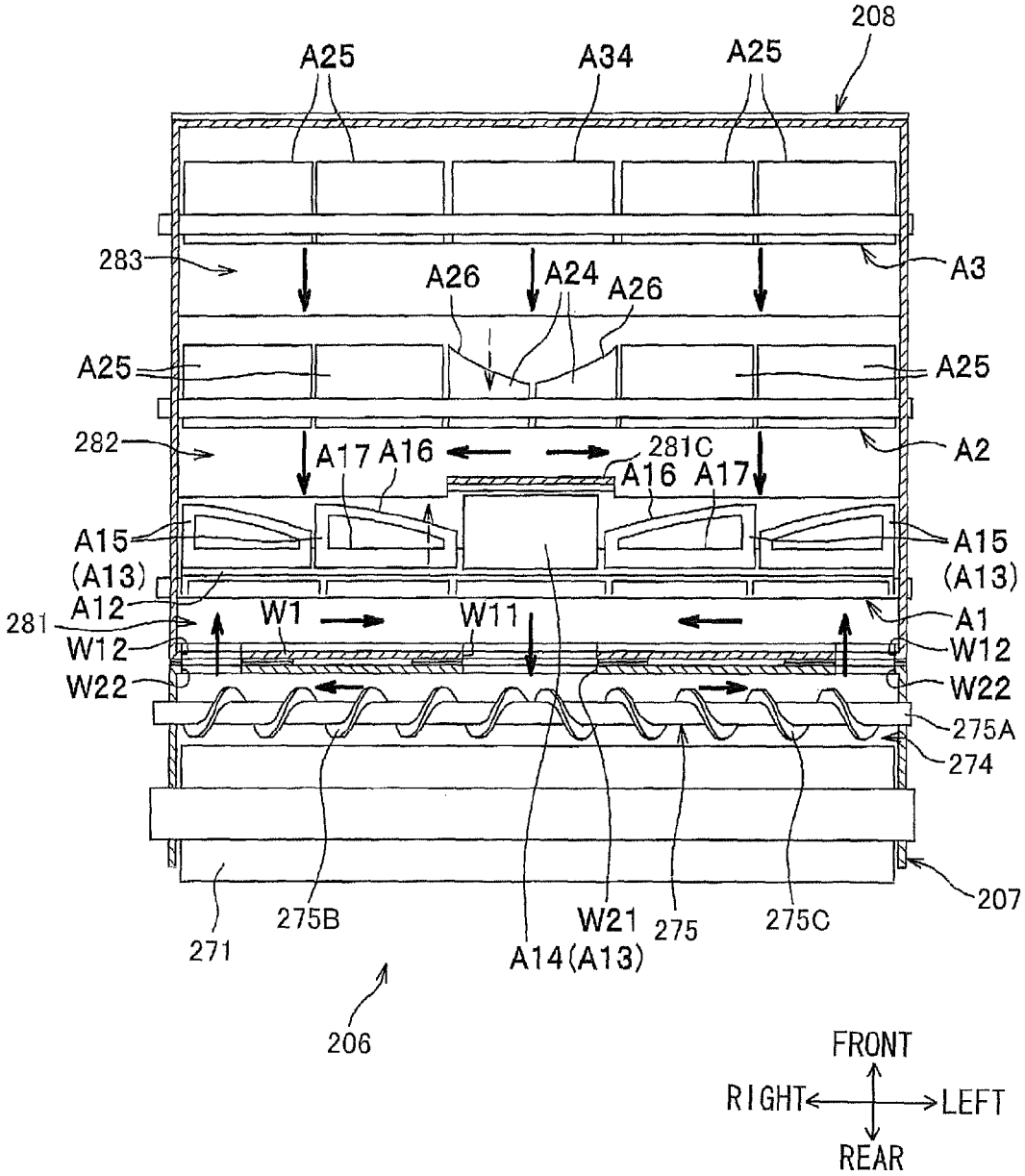
FIG. 15 is a schematic cross-sectional view of the developing unit showing an each room formed therein as viewed from top.

As shown in FIG. 15, the agitating blade A13 is configured of a first film A14 disposed in the left-to-right center thereof, and second films A15 disposed two on each of the left and right sides of the first film A14. Overall, the agitating blade A13 has a width capable of extending over both the first supply hole W11 and the second supply holes W12 (a sufficient width for sliding over both openings).

The first film A14 is a rectangular elastically deformable film formed at a width approximately equivalent to the width (left-to-right dimension) of the first supply hole W11. As shown in FIG. 12, the first film A14 is in a flexed state while contacting an opposed wall 281C formed between the first accommodating unit 281 and second accommodating unit 282 and having an arc-shaped cross section; and the first arc wall W1 (first supply hole W11), a top wall 281D, and a bottom wall 281E forming the first accommodating unit 281.

Figure 16:
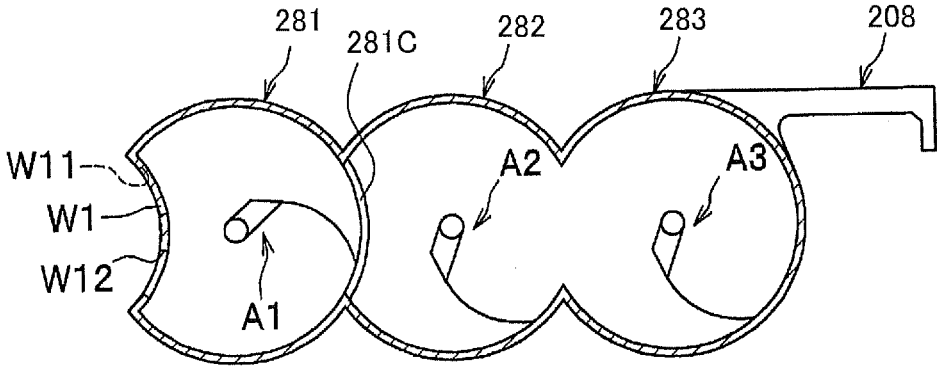
FIG. 16 is a schematic cross-sectional view of the toner cartridge taken along a line in which the second supply hole is formed as viewed from left side.

As shown in FIG. 15, the opposed wall 281C is erected for blocking a wide central opening that provides communication between the first accommodating unit 281 and second accommodating unit 282 (see also FIGS. 12 and 16). More specifically, the opposed wall 281C is disposed opposite the first supply hole W11 horizontally and is formed with a greater width than that of the first film A14. With this construction, toner can be suitably conveyed by the first film A14 upward between the first film A14 and opposed wall 281C and, thereafter, can be suitably conveyed toward the first supply hole W11 between the first film A14 and top wall 281D.

The second films A15 are elastically deformable films, each of which has a leading edge A16 that slides in contact with the inner surface of the first accommodating unit 281. The second films A15 are configured so that their leading edges A16 slope toward the rotational center of the first agitator A1 (rotational shaft A11) as the leading edges A16 approach the first film A14 side. Specifically, by forming the second films A15 of a suitable shape and setting the orientation mentioned-above, the second films A15 can slide over the inner surface of the first accommodating unit 281 in such a way that the inner portion of the leading edge A 16 in the left-to-right direction slides behind the outer portion in the left-to-right direction.

With the inner portions being behind the outer portions with respect to the left-to-right direction when the leading edges A16 of the second films A15 slide over the inner surface of the first accommodating unit 281, the second films A15 can convey toner from the second supply holes W12 formed in the left and right outer sides toward the first supply hole W11 formed in the center. Each of the second films A15 has a hole A17 formed in the center region thereof. The holes A17 are provided to ensure that the second films A15 do not push back more than the necessary amount of toner into the second accommodating unit 282 from among toner that was returned into the first accommodating unit 281 via the second supply holes W12.

As shown in FIG. 12, the second accommodating unit 282 is positioned adjacent to the first accommodating unit 281 in a horizontal direction when the toner cartridge 208 is mounted on the developing device 207 (and specifically when the developing unit 206 is mounted in the main casing 202). The main casing 202 has a substantially hollow, cylindrical shape. The rear end of the second accommodating unit 282 is in communication with the first accommodating unit 281 in all regions other than the opposed wall 281C described above, while substantially the entire front side is in communication with the third accommodating unit 283.

A second agitator A2 is disposed inside the second accommodating unit 282. The second agitator A2 functions to convey toner accumulated in the bottom of the second accommodating unit 282 toward the first accommodating unit 281 by rotating in a direction opposite the rotational direction of the first agitator A1 (clockwise in FIG. 12). The second agitator A2 includes a rotational shaft A21 and a support part A22 having substantially the same structure as the first agitator A1 described above, and an agitating blade A23 having a different structure from that in the first agitator A1.

As shown in FIG. 15, the agitating blade A23 is configured of a pair of elastically deformable third films A24 disposed in the left-to-right center of the agitating blade A23, and rectangular elastically deformable fourth films A25 disposed two on both the left and right sides of the third films A24.

The third films A24 are juxtaposed in the left-to-right direction and fall within the width of the opposed wall 281C. Each third film A24 has a leading edge A26 for slidingly contacting the inner surface of the second accommodating unit 282. The leading edges A26 slope toward the rotational center of the second agitator A2 (rotational shaft A21) as the leading edges A26 approach the adjacent third film A24 side. Specifically, by forming the third films A24 in a suitable shape and suitably setting the orientation mentioned-above, the third films A24 can rotate so that the outer portions of the leading edges A26 in the left-to-right direction are behind the inner portions of the leading edges A26 in the left-to-right direction when sliding along the inner surface of the second accommodating unit 282.

With the outer portions of the leading edges A26 in the left-to-right direction sliding over the inner surface of the second accommodating unit 282 behind the inner portions of the same, the third films A24 can convey toner outward in the left and right directions. Hence, the third films A24 serve as blades that convey toner from the left-to-right center to the left and right outer sides. Accordingly, toner conveyed by the third films A24 gravitates to the fourth film A25 sides so as to avoid the opposed wall 281C disposed on the rear side of the third films A24. Subsequently, the fourth films A25 supply the toner into the first accommodating unit 281.

As shown in FIG. 12, the third accommodating unit 283 is disposed adjacent to the second accommodating unit 282 in a horizontal direction when the toner cartridge 208 is mounted on the developing device 207 (and specifically when the developing unit 206 is mounted in the main casing 202). The third accommodating unit 283 has a substantially hollow cylindrical shape, with substantially the entire rear portion in communication with the second accommodating unit 282.

A third agitator A3 is disposed inside the third accommodating unit 283. The third agitator A3 conveys toner that accumulates in the bottom of the third accommodating unit 283 toward the second accommodating unit 282 by rotating in a direction opposite the rotating direction of the first agitator A1 (clockwise in FIG. 12). The third agitator A3 includes a rotational shaft A31 and a support part A32 having substantially the same structure as the second agitator A2 described above, and an agitating blade A33 having a slightly different structure from the second agitator A2.

As shown in FIG. 15, the agitating blade A33 has a single fifth film A34 that is rectangular in shape and elastically deformable disposed in the left-to-right center of the agitating blade A33, and fourth films A25 identical to those in the support part A22 disposed two on each of the left and right sides of the fifth film A34.

As shown in FIG. 13, a first agitator gear AG1, a second agitator gear AG2, and a third agitator gear AG3 are coaxially and integrally provided on one end of the respective first agitator A1, second agitator A2, and third agitator A3. Further, two gears G are disposed between the first agitator gear AG1 and second agitator gear AG2, and a single gear G is disposed between the second agitator gear AG2 and third agitator gear AG3. A coupling part CP is formed over the central shaft of the third agitator gear AG3.

With this construction, when a drive force from a drive source provided in the casing 202 (not shown) is transmitted to the coupling part CP formed on the third agitator gear AG3, the third agitator gear AG3 rotates in the same direction as the second agitator gear AG2 (counterclockwise in FIG. 13) and in the opposite direction as the first agitator gear AG1 (clockwise in FIG. 13). All of the gears are covered with a gear case 285. The gear case 285 is detachably mounted on the right side wall 284 of the toner cartridge 208.

The gear case 285 has a hole 285A formed therein for inserting the coupling part CP described above, and a shaft part 285B formed thereon and protruding outward (rightward). The gear case 285 functions to pivotably support an operating member 286 that serves to open and close the toner shutter S1 described above and a process shutter S2 described later (see FIG. 18) in association with each other.

The operating member 286 is disposed on the inner side of a cover member 287 that covers the outer side of the gear case 285. The operating member 286 primarily includes a base part 286A, an arm part 286B, and an operation engaging part 286C. The base part 286A has a circular plate shape with a hole 286D formed in the center thereof for rotatably engaging with the shaft part 285B. A plurality of protrusions 286E are formed along the rear edge of the base part 286A for engaging with a plurality of depressions S26 formed in a second engaging plate S25 described later (see FIG. 18).

The arm part 286B extends radially outward from the base part 286A (in approximately the forward direction. The operation engaging part 286C is disposed on the distal end of the arm part 286B and protrudes rightward therefrom. The operation engaging part 286C protrudes (is exposed) externally through an arc-shaped elongated hole 287A formed in the cover member 287.

Figure 17:
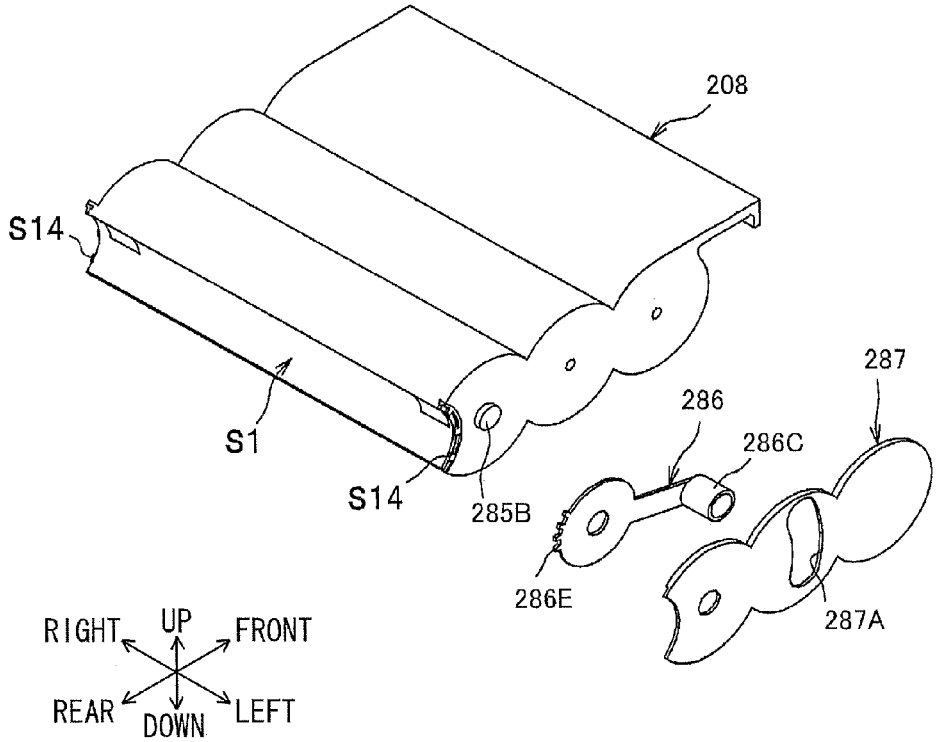
FIG. 17 is an exploded perspective view of the toner cartridge as viewed from left-front side.

In addition to the elongated hole 287A, a hole 287B for receiving the coupling part CP described above and a hole 287C for receiving the shaft part 285B are formed in the cover member 287. Further, the shaft part 285B, operating member 286, and cover member 287 having a construction similar to those described above are disposed on the left side of the toner cartridge 208, as shown in FIG. 17.

11. Structure of the Developing Device

As shown in FIG. 12, the developing device 207 further includes a developer case 276 in which the developing roller 271 is provided, a support case 277 that supports the process cartridge 205 from the underside thereof, a developing chamber 274 accommodating the developing roller 271 and the like described above, and an auger 275 disposed above the supply roller 273.

The front wall of the developing chamber 274 is a second arc wall W2 that opposes the first arc wall W1 of the toner cartridge 208 and curves in an arc-shape conforming with the first arc wall W1. A first through-hole W21 is formed in the upper half of the second arc wall W2 at a position in the left-to-right center thereof opposing the first supply hole W11 of the first arc wall W1. Second through-holes W22 are formed in the lower half of the second arc wall W2, with one in either left and right end thereof, at positions opposing the second supply holes W12 formed in the first arc wall W1.

Hence, the first through-hole W21 is disposed higher than the second through-holes W22 and provided communication in a direction diagonally downward from the developer cartridge 208 to the developing device 207. The second through-holes W22 provide communication in a direction diagonally upward from the toner cartridge 208 to the developing device 207.

Figure 18:
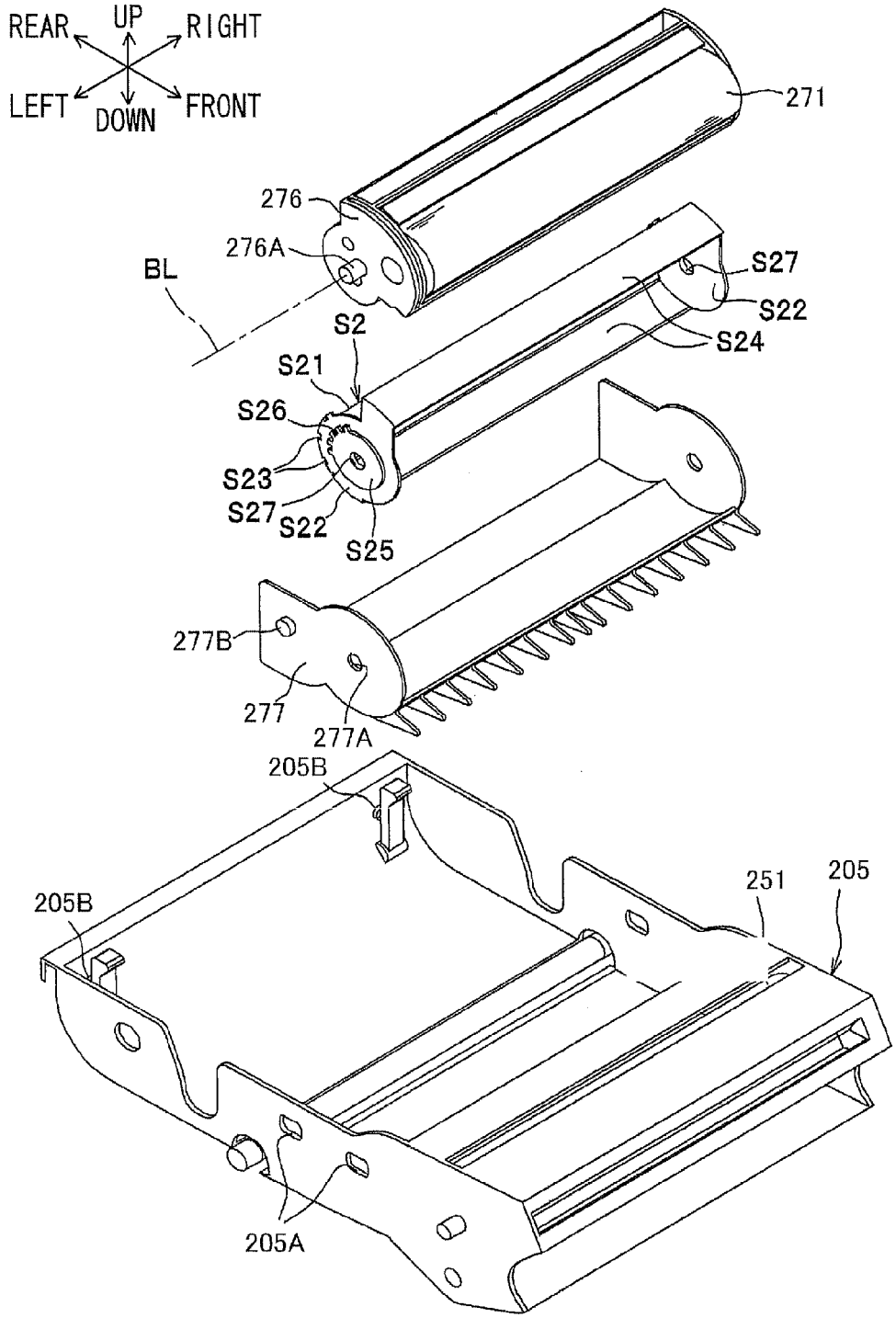
FIG. 18 is an exploded perspective view of a developing device and a process cartridge.
Figure 19A:
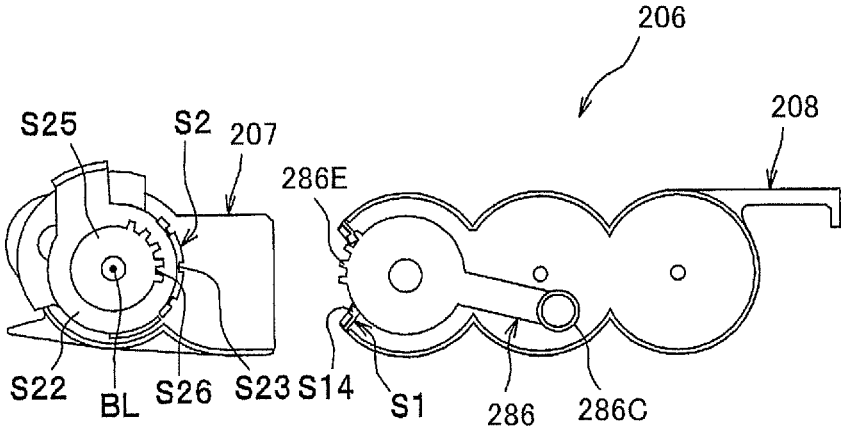
FIG. 19A is a schematic illustration of the developing unit when the toner shutter and a process shutter are close.
Figure 19B:
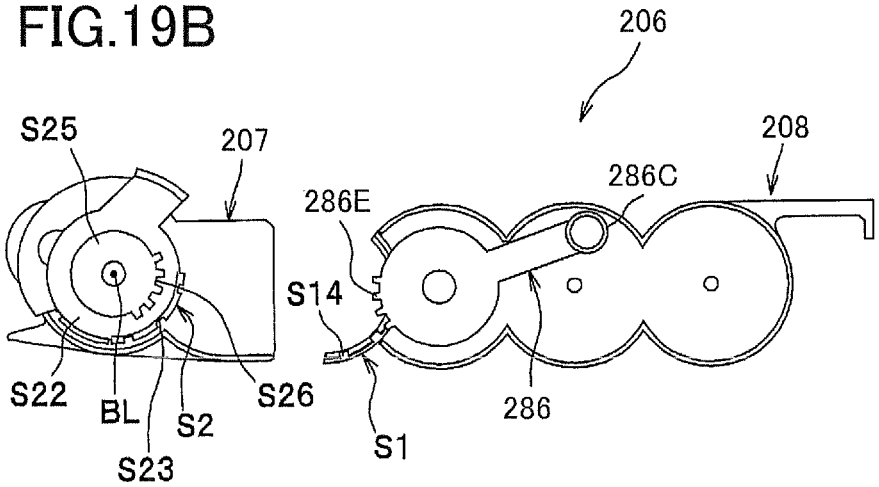
FIG. 19B is a schematic illustration of the developing unit when the toner shutter and a process shutter are open.

A process shutter S2 is provided on the front side of the second arc wall W2 form opening and closing the first through-hole W21 and second through-holes W22 by moving along the circumference of the second arc wall W2. As shown in FIGS. 18, 19A, and 19B, the process shutter S2 includes a metal plate S21, and a pair of engaging plates S22 disposed one on either left and right end of the metal plate S21.

The metal plate S21 is formed in the same shape as the metal plate S11 of the toner shutter S1 described earlier. By moving similarly to the metal plate S11, as shown in FIGS. 14A and 14B, the metal plate S21 opens and closes the first through-hole W21 and second through-holes W22 described above.

Each of the engaging plates S22 is disc-shaped and has a plurality of depressions S23 formed in the rear edge thereof for engaging with the plurality of protrusions S14 formed on the sliding piece S12 of the toner shutter S1. The left and right engaging plates S22 are also coupled together by two beam-like plates S24. The beam-shaped plates S24 ensure that the rigidity of the process shutter S2 is maintained.

A disc-shaped second engaging plate S25 is coaxially disposed on the outer surface of each engaging plate S22. A plurality of depressions S26 is formed in the rear edge of each second engaging plate S25 for engaging with the plurality of protrusions 286E on the operating member 286 described above.

An engaging hole S27 is formed in the center portions of each engaging plate S22 and second engaging plate S25. The engaging holes S27 rotatably engage with rotational shafts 276A protruding outward from the developer case 276 supporting the developing roller 271. Through this construction, the process shutter S2 can rotate relative to the developer case 276.

The support case 277 has support holes 277A formed one in either widthwise side wall thereof. The rotational shafts 276A of the developer case 276 penetrate and are supported in the support holes 277A. The support case 277 also has columnar-shaped protrusions 277B formed one on each widthwise side wall thereof so as to protrude outward. The protrusions 277B formed on the support case 277 and the rotational shafts 276A inserted through the support holes 277A are loosely supported in the elongated holes 205A of the process cartridge 205 so as to be capable of shifting slightly in the front-to-rear direction.

As shown in FIGS. 19A and 19B, the process shutter S2 having the above construction is configured to open and close together with the toner shutter S1 in association with the pivoting of the operating member 286. For convenience, the developing device 207 and toner cartridge 208 are shown separated in FIGS. 19A and 19B.

In FIG. 19A, the toner shutter S1 and the process shutter S2 is in a closed position. Specifically, the first supply hole W11 and second supply holes W12 are closed by the toner shutter S1 and the first through-hole W21 and the second through-holes W22 are closed by the process shutter S2, at which time the operation member 286 is positioned downward. When the operation engaging part 286C of the operating member 286 is pivoted upward from the closed position, the protrusions 286E formed on the operating member 286 push the depressions S26 of the second engaging plate S25 downward, causing the process shutter S2 to rotate clockwise as shown in FIG. 19B. When the process shutter S2 is rotated in this way, the depressions S23 formed in the engaging plates S22 push the protrusions S14 formed on the toner shutter S1 in the clockwise direction of FIG. 19. Accordingly, the toner shutter S1 rotates clockwise together with the process shutter S2.

Consequently, the first supply hole W11 and second supply holes W12 are opened (see FIGS. 14A and 14B). To close the first supply hole W11 and second supply holes W12, the operation engaging part 286C of the operating member 286 is pivoted downward, i.e., in the direction opposite that described above. Accordingly, the toner shutter S1 and process shutter S2 rotate counterclockwise in FIG. 19 and close the first supply hole W11 and second supply holes W12.

As shown in FIG. 15, the auger 275 is configured to convey toner supplied through the first through-hole W21 toward the left and right second through-holes W22. Specifically, the auger 275 includes a rotational shaft 275A, and a first helical blade 275B and a second helical blade 275C wound in spiral shapes about the rotational shaft 275A.

The first helical blade 275B and second helical blade 275C are respectively disposed on right and left sides of the rotational shaft 275A, separated by the axial center thereof (a point near the first through-hole W21. The spiraling directions of the first helical blade 275B and second helical blade 275C are opposite each other, so that the first helical blade 275B conveys toner rightward and the second helical blade 275C conveys toner leftward.

12. The Flow of Toner

Next, the flow of toner in the developing unit 206 will be described. The third agitator A3 in the third accommodating unit 283 supplies toner from the third accommodating unit 283 into the second accommodating unit 282. The third films A24 of the second agitator A2 convey toner in the second accommodating unit 282 outward in the left and right directions, after which the fourth films A25 supply this toner into the first accommodating unit 281. As shown in FIG. 12, the agitating blade A13 of the first agitator A1 rotates and slidingly contacts the opposed wall 281C in the first accommodating unit 281, pushing toner within the first accommodating unit 281 upward. As the agitating blade A13 continues to rotate, the toner supported on the agitating blade A13 is conveyed along the top wall 281D and over the top of the first supply hole W11.

Through this conveyance, the toner falls by its own weight in a downward slope through the open first supply hole W11 and first through-hole W21 and is supplied into the developing device 207. The auger 275 then conveys the toner supplied into the developing device 207 outward in the left and right directions, as shown in FIG. 15.

Through this process, the toner is spread over substantially the entire width of the supply roller 273, enabling the supply roller 273 to supply toner to the developing roller 271 effectively. Further, when toner agitated by the auger 275 in the developing device 207 migrates over the second through-holes W22, the toner drops by its own weight in downward slope through the second through-holes W22 and the second supply holes W12 and returns to the first accommodating unit 281.

When toner is returned to the first accommodating unit 281, the second films A15 of the first agitator A1 convey the toner toward the left-to-right center thereof, while the first film A14 supplies the toner back through the first supply hole W11, as shown in FIG. 15.

13. Operations and Effects of the Second Embodiment

The following effects can be obtained by the laser printer 201 according to the second embodiment described above. As the first agitator A1 (first film A14) slides over the first arc wall W1 in a direction from top to bottom, i.e. the first supply hole W11 is formed on the upstream side of the first arc wall W1 with respect to the rotational direction of the first agitator A1, the first agitator A1 can push toner through the first supply hole W11 and effectively supply toner to the developing device 207. Further, since the first agitator A1 (second films A15) rotate in a manner for pushing toner away from the second supply holes W12, the structure of the first agitator A1 inhibits toner that was returned into the first accommodating unit 281 through the second supply holes W12 from being pushed back into the developing device 207. Hence, this construction improves circulation of the toner.

Since the second agitator A2 rotates in a direction opposite the rotating direction of the first agitator A1, the second agitator A2 can supply toner from the bottom of the second accommodating unit 282 into the first accommodating unit 281, thereby effectively conveying toner from the second accommodating unit 282 to the first accommodating unit 281. Further, since the third agitator A3 rotates in the same direction as the second agitator A2, the third agitator A3 can effectively convey toner from the third accommodating unit 283 into the second accommodating unit 282.

By disposing the opposed wall 281C between the first accommodating unit 281 and second accommodating unit 282, toner can be retained between the first agitator A1 and opposed wall 281C, enabling the first agitator A1 to convey toner effectively to the first supply hole W11 disposed in the top of the first arc wall W1. Further, since the opposed wall 281C is formed with an arc-shaped cross section, the first agitator A1 can convey toner smoothly upward.

By providing the second films A15 on the first agitator A1 for conveying toner from the second supply holes W12 toward the first supply hole W11, toner returned into the first accommodating unit 281 can be conveyed back toward the first supply hole W11. Hence, this construction further improves circulation of the toner.

By forming the first supply hole W11 as an opening that slopes downward into the developing device 207 and the second supply holes W12 as openings that slope upward toward the developing device 207, the weight of the toner can be used to supply toner into the developing device 207 and return toner from the developing device 207, thereby improving the circulation of toner between the developing device 207 and developer cartridge 208.

By forming the first supply hole W11 higher than the second supply holes W12, the second embodiment inhibits toner accumulated in the developing device 207 from flowing back into the first accommodating unit 281 through the first supply hole W11, while effectively encouraging the return of toner through the second supply holes W12 disposed lower than the first supply hole W11.

By forming the adjoining wall 281A of the first accommodating unit 281 as the first arc wall W1 having an arc-shaped cross section that is concave on the side facing the interior of the first accommodating unit 281, the first supply hole W11 and second supply holes W12 can be formed with a desired slope simply by forming holes in the upper half and lower half of the first arc wall W1. Therefore, circulation of toner can be improved through a simple construction.

By providing the toner shutter S1 for opening and closing the first supply hole W11 and second supply holes W12, the second embodiment can prevent toner from leaking when the toner cartridge 208 is not mounted in the developing device 207. Further, the construction for moving the toner shutter S1 along the circumference of the first arc wall W1 is simpler than a construction for moving the shutter in the axial direction of the agitator. Further, having a toner shutter S1 with an arc-shaped cross section rotating about its center axis (the reference line BL), as described in the second embodiment, ensures stable opening and closing operations. Specifically, the shutter does not tilt during movement, as can occur when using a flat plate-shaped shutter that is moved linearly.

Since two second supply holes W12 are provided in the second embodiment, toner in the developing device 207 can be more easily returned to the first accommodating unit 281.

The second embodiment further improves the circulation of toner by providing one first supply hole W11 in the left-to-right center of the first supply hole W11 and one second supply hole W12 on each of the left and right ends of the first arc wall W1, and by disposing the auger 275 in the developing device 207 for conveying toner from the center toward both left and right ends of the developing device 207.

Providing the second supply holes W12 outside of the printing area PA inhibits the accumulation of toner outside of the printing area PA more so than within the printing area PA. Accordingly, this construction can suppress the occurrence of light image densities caused when only a small amount of toner has accumulated within the printing area PA.

The auger 275 provided for conveying toner received through the first through-hole W21 toward the second through-holes W22 further improves the circulation of toner.

By providing the cover member 287 for covering the operating member 286 and exposing only a portion of the operating member 286 (the operation engaging part 286C) through the elongated hole 287A formed in the cover member 287, the construction of the second embodiment inhibits foreign matter from entering between the operating member 286 and the toner cartridge 208 more than a structure that does not include such a cover member, for example. Hence, this construction improves operability.

While the invention has been described in detail with reference to the embodiments thereof, it would be apparent to those skilled in the art that various changes and modifications may be made therein without departing from the spirit of the invention.

In the first embodiment described above, the intermediate transfer type color printer 1 shown in FIG. 1 temporarily transfers a toner image in each color from the respective photosensitive drum 19 to the intermediate transfer belt 27, and subsequently transfers the entire color toner image onto a sheet of paper P. However, the present invention is not limited to an intermediate transfer type color printer. For example, the invention may be applied to a direction transfer type color printer in which toner images are transferred directly from each photosensitive drum 19 onto the sheet of paper.

Further, the curved wall 103 is depressed inward the circular center of the circumferential wall 101 to form an arc-shaped curve. However, the curved wall may not be a good "arc-shaped curve" if the toner shutter 112 can slide along the circumferential direction of the curved wall 103 between the open position and the close position.

Further, while the photosensitive drums 19 are exposed by laser beams emitted from the scanning unit 10 in the color printer 1 of the first embodiment, the photosensitive drums 19 may be exposed using LEDs (Light-Emitting Diode) instead of the scanning unit 10.

In the second embodiment described above, the first supply hole W11 is disposed above the second supply holes W12, but the vertical arrangement of the first supply hole W11 and second supply holes W12 may be reversed or, alternatively, the first supply hole W11 and second supply holes W12 may be arranged at the same vertical position. Further, the left-to-right positions and the numbers of the first and second supply holes are not limited to the description in the second embodiment, but may be set as desired.

While the present invention is applied to the laser printer 201 in the second embodiment described above, the present invention may be applied to other image-forming devices such as photocopiers or multifunction peripherals.

What is claimed is:

1. A toner cartridge comprising:

a first toner accommodating unit having a peripheral surface in which an inner hollow space for accommodating a toner is formed; and an agitating member disposed in the first toner accommodating unit and configured to rotate about a rotational shaft in a rotating direction to agitate the toner, the agitating member having a radial length in a radial direction, wherein the peripheral surface has a wall portion formed with a first supply-hole at an upstream side in the rotating direction, the wall portion being curved about a reference line as a center of curvature and depressed inward of the first toner accommodating unit, the reference line being outside of the first toner accommodating unit in a radial direction of the agitating member and extending in a prescribed direction, the wall portion having a first wall defining one end portion of the first supply-hole and a second wall defining another end portion of the first supply-hole, wherein the first supply-hole penetrates along the rotating direction, and wherein a distance between the first wall and the rotational shaft is larger than a distance between the second wall and the rotational shaft, and is smaller than the radial length of the agitating member.

2. The toner cartridge according to claim 1, further comprising a toner shutter for opening and closing the first supply hole by moving along the wall portion.

3. The toner cartridge according to claim 2, wherein the agitating member includes an agitating portion extending radially outward from a rotational axis of the agitating member and having flexibility.

4. The toner cartridge according to claim 2, wherein the first toner accommodating unit has a cross section having a substantially cylindrical shape when viewed from the prescribed direction.

5. The toner cartridge according to claim 2, wherein the toner shutter is supported by the first toner accommodating unit at multiple points along the prescribed direction.

6. The toner cartridge according to claim 1, wherein when the toner cartridge is mounted in a developing device, the toner cartridge is adjacent to the developing device in a horizontal direction, wherein the wall portion is formed with a second supply hole at a position on a downstream side of the first supply hole in the rotating direction.

7. The toner cartridge according to claim 6, wherein the second supply hole is formed at a position lower than the first supply hole in a vertical direction, and the first supply hole and the second supply hole penetrate the wall portion from the toner cartridge to the developing device, and wherein the agitating member rotates in the toner cartridge so as to scrape over the wall portion in a direction from top to bottom.

8. The toner cartridge according to claim 7, further comprising:

a second toner accommodating unit that accommodates the toner and disposed at a position adjacent to the first toner accommodating unit in a horizontal direction; and a transfer member provided in the second toner accommodating unit and that rotates to convey the toner toward the first toner accommodating unit, wherein the rotational direction of the agitating member is opposite to the rotational direction of the transfer member.

9. The toner cartridge according to claim 8, further comprising an opposed wall that is formed between the first toner accommodating unit and the second toner accommodating unit and that is disposed opposite the first supply hole, wherein the agitating member slidingly contacts the opposed wall during the rotation.

10. The toner cartridge according to claim 6, wherein the first supply hole offsets from the second supply hole in a rotational axis direction of the agitating member, and the agitating member includes a transfer blade for transferring toner from the second supply hole to the first supply hole.

11. A developing device comprising:

a casing;

a supply roller mounted on the casing; and a toner cartridge mountable on the casing, wherein the toner cartridge comprises:

a first toner accommodating unit having a peripheral surface in which an inner hollow space for accommodating a toner is formed; and an agitating member disposed in the first toner accommodating unit and configured to rotate about a rotational shaft in a rotating direction to agitate the toner, the agitating member having a radial length in a radial direction, wherein the peripheral surface has a wall portion formed with a first supply-hole at an upstream side in the rotating direction, the wall portion being curved about a reference line as a center of curvature and depressed inward of the first toner accommodating unit, the reference line being outside of the first toner accommodating unit in a radial direction of the agitating member and extending in a prescribed direction, the wall portion having a first wall defining one end portion of the first supply-hole and a second wall defining another end portion of the first supply-hole, wherein the first supply-hole penetrates the wall portion along the rotating direction, and wherein a distance between the first wall and the rotational shaft is larger than a distance between the second wall and the rotational shaft, and is smaller than the radial length of the agitating member.

12. The developing device according to claim 11, wherein the wall portion has an arc-shape conforming with a circumferential surface of the supply roller, and the casing has an arc wall opposed to the wall portion and conforming with the arc-shape of the wall portion.

13. The developing device according to claim 12, wherein the arc wall is formed with a through-hole in confrontation with the first supply hole, the developing device further comprising a process shutter for opening and closing the through-hole.

14. The developing device according to claim 13, wherein the process shutter is supported by the casing at multiple points along the prescribed direction.

15. The developing device according to claim 13, wherein the toner cartridge further comprises a toner shutter for opening and closing the first supply-hole by moving along the peripheral surface and an operation part that engages with the toner shutter, and wherein movement of the operation part is interlocked with movement of the process shutter.

16. The developing device according to claim 13, wherein the toner cartridge further comprises a toner shutter for opening and closing the first supply hole by moving along the peripheral surface, and wherein the toner shutter includes a first connection member, and the process shutter includes a second connection member, the first connection member being engaged with the second connection member when the toner cartridge is mounted in the casing, wherein movement of the toner shutter is interlocked with movement of the process shutter.

17. The developing device according to claim 11, wherein the supply roller is disposed at a vertically higher position than the first toner accommodating unit.

18. An image forming device comprising:

a main casing;

a plurality of photosensitive drums configured to rotate about a rotational axis extending in an axial direction;

a plurality of developing devices configured to confront the plurality of photosensitive drums, a plurality of toner cartridges accommodating a toner and detachably mounted on the plurality of developing devices to supply the toner; and a support frame that is drawable from the main casing in a direction orthogonal to the axial direction while integrally supporting the plurality of developing devices and the plurality of toner cartridges, the support frame having a first wall and a second wall opposite to the first wall in the axial direction, the first wall and the second wall being located outside of the toner cartridge in the axial direction, one of the first wall and the second wall being formed with an exposure hole that allows the toner cartridge to be detached from the corresponding developing device while maintaining the corresponding developing device to be supported, when the support frame is drawn from the main casing, the exposure hole being formed at a position aligned with the toner cartridge in the axial direction, wherein the toner cartridge is detached from the corresponding developing device through the exposure hole in a direction parallel to the axial direction of the photosensitive drum.

19. The image forming device according to claim 18, further comprising a shutter for allowing and restricting movement of toner by opening and closing a passage between the toner cartridge and the corresponding developing device, wherein the toner cartridge further comprises an operation part that is provided on an upstream side of the toner cartridge in the direction.

20. The image forming device according to claim 18, wherein the toner cartridge further comprises:

an agitating member that is provided in the toner cartridge for agitating toner upon receiving a drive force; and a transmitting member provided on downstream side of the toner cartridge with respect to the direction and configured to be coupled to the main casing in order to receive the drive force and to transmit the drive force to the agitating member.

21. The image forming device according to claim 18, wherein the toner cartridge further comprises:

a first toner accommodating unit having a peripheral surface in which an inner hollow space for accommodating a toner is formed; and an agitating member disposed in the first toner accommodating unit and configured to rotate in a rotating direction to agitate the toner, wherein the peripheral surface has a wall portion formed with a first supply-hole at an upstream side in the rotating direction, the wall portion being curved about a reference line as a center of curvature and depressed inward of the first toner accommodating unit, the reference line being outside of the first toner accommodating unit in a radial direction of the agitating member and extending in a prescribed direction.

22. The image forming device according to claim 21, wherein the toner cartridge further comprises a toner shutter for opening and closing the first supply hole by moving along the wall portion.

23. The image forming device according to claim 22, wherein the agitating member includes an agitating portion extending radially outward from a rotational axis of the agitating member and having a flexibility.

24. The image forming device according to claim 22, wherein the first toner accommodating unit has a cross section having a substantially cylindrical shape when viewed from the prescribed direction.

25. The image forming device according to claim 22, wherein the toner shutter is supported by the first toner accommodating unit at multiple points along the prescribed direction.

26. The image forming device according to claim 21, wherein the wall portion has an arc-shape conforming with a circumferential surface of a supply roller, and wherein the developing device further comprises a casing, and the casing has an arc wall opposed to the wall portion and conforming with the arc-shape of the wall portion.

27. The image forming device according to claim 26, wherein the arc wall is formed with a through-hole in confrontation with the first supply hole, the developing device further comprising a process shutter for opening and closing the through-hole.

28. The image forming device according to claim 27, wherein the process shutter is supported by the casing at multiple points along the prescribed direction.

29. The image forming device according to claim 27, wherein the toner cartridge further comprises a toner shutter for opening and closing the first supply-hole by moving along the peripheral surface and an operation part that engages with the toner shutter, wherein movement of the operation part is interlocked with movement of the process shutter.

30. The image forming device according to claim 27, wherein the toner cartridge further comprises a toner shutter for opening and closing the first supply hole by moving along the peripheral surface, and wherein the toner shutter includes a first connection member, and the process shutter includes a second connection member, the first connection member being engaged with the second connection member when the toner cartridge is mounted in the casing, wherein movement of the toner shutter is interlocked with movement of the process shutter.

31. The image forming device according to claim 26, wherein the supply roller is disposed at a vertically higher position than the first toner accommodating unit.

32. The image forming device according to claim 26, wherein the arc wall of the developing device protrudes downwardly, and the arc wall has an accumulating portion positioned lower than a lower edge of the through hole.

33. A toner cartridge comprising:

a first toner accommodating unit having a peripheral surface in which an inner hollow space for accommodating a toner and that has a wall portion formed with a first supply-hole;

a toner shutter for opening and closing the first supply hole by moving along the wall portion; and an agitating member disposed in the first toner accommodating unit and configured to rotate about a rotational shaft in a rotating direction to agitate the toner, the agitating member having a radial length in a radial direction, wherein the wall portion is curved about a reference line as a center of curvature and depressed inward of the first toner accommodating unit, the reference line being outside of the first toner accommodating unit and extending in a prescribed direction, the wall portion having a first wall defining one end portion of the first supply-hole and a second wall defining another end portion of the first supply-hole, wherein the first supply-hole penetrates the wall portion along the rotating direction, and wherein a distance between the first wall and the rotational shaft is larger than a distance between the second wall and the rotational shaft, and is smaller than the radial length of the agitating member.

34. The toner cartridge according to claim 33, wherein the first supply-hole is formed at a position upstream side of the wall portion in the rotating direction.

35. The toner cartridge according to claim 34, wherein the agitating member includes an agitating portion extending radially outward from a rotational axis of the agitating member and having flexibility.

36. The toner cartridge according to claim 33, the first toner accommodating unit has a cross section having a substantially cylindrical shape when viewed from the prescribed direction.

37. The toner cartridge according to claim 33, the toner shutter is supported by the first toner accommodating unit at multiple points along the prescribed direction.

* * * * *